US005537851A

United States Patent [19]

Sheu et al.

[11] Patent Number: 5,537,851

[45] **Date of Patent: * Jul. 23, 1996**

[54] SHEET PRODUCT PRODUCED BY MASSIVE REDUCTION IN LAST STAND OF COLD ROLLING PROCESS

[75] Inventors: Shen S. Sheu; Louis G. Hector, Jr., both of Murrysville, Pa.

[73] Assignee: Aluminum Company of America, Pittsburgh, Pa.

[ * ] Notice: The portion of the term of this patent subsequent to Feb. 3, 2012, has been disclaimed.

[21] Appl. No.: 238,249

[22] Filed: May 4, 1994

Related U.S. Application Data

[63] Continuation-in-part of Ser. No. 666, Jan. 5, 1993, abandoned.

[51] Int. Cl.[6] ..... B21B 1/24

[52] U.S. Cl. ..... 72/366.2; 428/687

[58] Field of Search ..... 72/199, 196, 197, 72/198, 365.2, 366.2; 428/600, 687, 923

[56] References Cited

U.S. PATENT DOCUMENTS

| | | | |
|---|---|---|---|
| 3,487,674 | 3/1962 | Fujimoto | 72/366.2 |
| 4,046,602 | 9/1977 | Stanley | 148/111 |
| 4,119,442 | 10/1978 | Nagumo et al. | 148/2 |
| 4,996,113 | 2/1991 | Hector et al. | 428/600 |
| 5,250,364 | 10/1993 | Hector, Jr. et al. | 428/687 |

FOREIGN PATENT DOCUMENTS

| | | | |
|---|---|---|---|
| 273402 | 8/1989 | European Pat. Off. | 72/366.2 |

*Primary Examiner*—Lowell A. Larson
*Assistant Examiner*—Thomas C. Schoefeler
*Attorney, Agent, or Firm*—Elroy Strickland

[57] ABSTRACT

A bright rolled metal strip product having a surface that contains multiple microscopic raised prows formed by partial back extrusion of strip material into smooth, bowl-shaped depressions provided in a work roll surface. The prows are formed by smearing of the strip surface that results from the relative velocities of the strip and work rolls that occurs when massive reductions are taken in the thickness of the strip by the work rolls.

4 Claims, 21 Drawing Sheets

SHEET PRODUCT PRODUCED BY MASSIVE REDUCTION IN LAST STAND OF COLD ROLLING PROCESS

This application is a continuation-in-part of U.S. application Ser. No. 08/000,666, filed Jan. 5, 1993, now abandoned.

BACKGROUND OF THE INVENTION

The present invention relates generally to metal sheet products for constructing bodies of motor vehicles, for example, using increased percentage sheet thickness reduction ratios attainable with a work roll texture in a single final stand of a rolling mill over that attainable with directionally ground rolls in multiple stands. The metal sheet provided has enhanced functional properties for subsequent manufacturing processes, such as forming capability in presses, spot weldability, resistance to galling or adhesive metal transfer from the sheet surface to the tool surface in presses that form the sheet into components, and the appearance of sheet surfaces before and after they are painted or coated.

The disclosure of Applicants' earlier U.S. Pat. No. 5,025,547, issued Jun. 25, 1991, is hereby incorporated by reference. This patent concerns itself with micro-engineered surface textures for both work and back-up rolls of each stand of a rolling mill so that each stand is tailored to its particular rolling conditions involving lubrication, wear and traction, with the final stand of the mill reducing the thickness of the strip or sheet in a manner that embosses the surface of the sheet product with the surface texture of the work rolls. This is described at the bottom of column 3 of the patent, beginning with line 63. The surface texture of a work roll in the last stand of the rolling process is shown in the micrograph of FIG. 5 of the patent drawings in U.S. Pat. No. 5,025,547. It should be noted that textures formed in and on a strip surface in all stands but the last one are generally eliminated from the sheet surface by the action of work rolls in later stands of the rolling mill.

In addition, the work rolls of the final stand of Applicants' above patent can be provided with a continuous helical groove, as described at the top of column 4 of the patent. Such a texture would produce the sheet surface shown in FIG. 28 of Applicants' present drawings. The continuous helical groove texture is anisotropic (directional) and the resulting texture on the sheet is also directional, as shown in FIG. 28 of the present application. It is difficult with such a texture to take massive reductions in sheet thickness, i.e., reduction ratios that are at or in excess of 55%. The purpose of the groove texture is to remove lubricant by squeezing the lubricant to the channels in the roll texture. Hence, the sheet/work roll interface is not sufficiently lubricated so as to effect a massive thickness reduction in the final stand of a cold rolling process. The helicoidal groove texture was designed for low reduction rolling processes where the goal is to roll at high speeds to produce a sheet product that is very bright, i.e., has enhanced specular reflectivity.

Also, with the crater texture of FIG. 5 of the above patent, such massive reductions are not contemplated, as an objective of the patent is to produce an isotropic and non-directional surface of the final sheet product by embossing the sheet surface with the work roll surface texture prior to the sheet exiting the rolling mill. Any massive reductions in thickness cause substantial smearing of the sheet surface, as explained in detail hereinafter. In the above patent, the reductions are in the range of 15% to 54%, which range contains sheet thickness reductions that are substantially in excess of those taken during "temper" rolling, which involves sheet thickness reductions on the order of three to ten percent.

Steel and aluminum sheet are products made in rolling mills that employ work rolls to engage the sheet in a thickness reducing process. The ground surfaces of the work rolls can be provided with different textures using such finishing techniques as sand blasting, electric discharge texturing (EDT), $CO_2$ laser texturing, and electron beam texturing. These methods can provide a variety of micro-roughness morphologies ranging from minute craters, which are positioned in a discrete fashion along the work roll surfaces (such as is shown in FIG. 3 of the present drawings), to rugged irregularities which possess a significant random element (such as shown in FIG. 13). Laser and electron beam technologies are able to provide deterministic crater patterns in work roll surfaces, whereas the crater pattern provided by electric discharge machining has a substantial random element, as shown in FIG. 13. These technologies are generally described in *Iron and Steel Engineer,* Vol. 68, No. 8, August 1991, and in the Applicants' article "Focused Energy Beam Work Roll Surface Texturing Science and Technology", *Journal of Materials Processing and Manufacturing Science,* Vol. 2, July 1993.

The work roll surface textures provided by the aforementioned technologies are used to emboss the sheet surface during light percentage sheet thickness reduction rolling processes (e.g. typically equal to or less than 5% thickness reduction). A work roll surface having a crater texture similar to that shown in FIG. 3 will imprint the sheet surface in the manner shown in FIG. 4. This provides the sheet surface with an array of annular recessions surrounding plateau regions, the surfaces of the latter displaying the ground finish on the work roll prior to texturing.

Presently, such textured work roll surfaces are commonly used to manufacture autobody sheet. However, a number of significant rolling process-related problems continue to persist for reasons discussed below. These problems tend to worsen as the percentage sheet thickness reductions taken during a rolling process become heavier and heavier, thereby precluding the use of the texture in accompanying FIG. 3 beyond a certain light reduction.

For example, the percentage sheet thickness reduction ratios achievable with directionally ground rolls bottoms out at relatively low roll gap forces and roll torques, as discussed in detail hereafter.

Similarly, with a small sheet thickness percentage reduction ratio in a cold rolling process (e.g., typically less than 3%) at a relatively low speed (e.g., 500 ft/min) with no lubricant, the topography of a work roll surface may be only partially imprinted or embossed on the sheet surface due to imperfect texture formation on the work roll surface. Such imperfect texture formation can be due to irregular absorption of beam energy by various alloying agents in the work roll steel, for example, thereby leading to an imperfect work roll surface texture. FIG. 5 of the accompanying drawings is an example of imperfect texture formation, FIG. 5 showing a stylus rendered topography of a representative area of a steel sheet surface that shows imperfect embossing of a work roll annular crater texture (similar to that shown in FIG. 3) foraged by electron beam technology.

The embossed sheet roughness typically meets the functional requirements of steel autobody sheet and can have a better painted surface appearance than that of a conventional sheet surface rolled with a work roll having a substantially anisotropic roughness in the form of a directional grind. However, the distinctness of image of the painted surface of a sheet textured with a discrete roughness is not optimized due to the background roughness imparted from the ground portions of the roll surface (as seen in accompanying FIG. 4), as well as by the texture itself which may show through a painted finish.

Wear debris generation during the rolling of metal sheet is one of the most significant rolling process problems associated with roll surface textures produced with the $CO_2$, electron beam, and electric discharge texturing devices. In order to better understand the nature of this wear mechanism, some mention of the texture morphology produced with these devices is in order. In the case of the $CO_2$ laser and electron beam devices, a single element of the roughness produced with these devices, known as a "crater," is generated by one or more pulses of sufficient average energy density (which is the product of the beam intensity and the pulse activation time) so as to melt a microscopic quantity of the work roll surface, the individual pulses consisting of electromagnetic radiation in the case of the $CO_2$ laser, or accelerated electrons in the case of the electron beam device. Each crater consists of a nearly annular rim, which is raised relative to the average roughness of the roll surface, and a recessed region, typically referred to as a depression, formed in the roll surface, as shown in FIG. 8. The crater rim is generally inclined relative to the average roll roughness such that its angle of inclination or slope is quite steep (e.g., 15° to 50°). By adjusting the angle of a high velocity gas assist relative to the position at which the pulsed beam impinges on the roll surface, the $CO_2$ device can produce an asymmetric crater morphology which consists of a single raised "hump" and a single depression. FIG. 10 is a stylus-rendered topography of such raised humps in a representative area on a work roll surface. The slope of any one hump relative to the average roll roughness is also quite large.

The embossed sheet surface texture resulting from light percentage sheet thickness reduction rolling with a work roll texture provided by electric discharge technology (EDT) typically consists of a series of plateaus and recessed regions, in no discernible order, which are generated (in reverse) on the work roll surface by multiple sparks of discharge electrodes through a dielectric (i.e., initially non-conductive) fluid medium. The plateau edges are also quite steep and jagged. This is seen in FIG. 13 of the accompanying drawings. FIG. 13 is a stylus-rendered topography of a 2008 aluminum alloy sheet surface, the steep and jagged surface being the imprint of a work roll surface textured with an electrical discharge device.

A microcutting wear mechanism, therefore, tends to be the dominant mode of wear debris generation in the roll bite of textured work rolls. With work rolls used in rolling automotive sheet, for example, the average crater rim height or the average height of an asymmetric "hump" typically exceeds the average background work roll roughness which results from the roll grinding operation. As such, microcutting occurs when the crater rims or asymmetric "humps" plow the sheet surface thereby dislodging small particles from the sheet surface. The total volume of wear debris generated in the roll bite when rolling with a textured roll is proportional to the sliding distance between the work roll and the sheet surfaces. The sliding distance is a function of sheet gauge thickness, thickness reduction ratio, and the work roll diameter. Another contributing factor to wear debris generation in the textured roll bite is the average slope of the crater rim or the asymmetric "hump" relative to the average background roll roughness. If this slope generally exceeds 20° or so, then one can expect high levels of wear debris in rolling processes where sheet thickness reductions exceeding 15% are taken.

Excessive wear debris thus leads to an aesthetical problem with the final sheet product since the debris can either be rolled into the sheet, or it can be transferred to the work roll surface where it can act like sharp cutting edges that further damage the sheet surface. For this reason, the use of textured rolls has generally been limited to temper, light percentage sheet thickness reduction ratio rolling, as there is relatively little sliding between the work roll surface and the sheet surface. Such a low reduction tends not to generate a substantial amount of debris.

Temper rolling is occasionally performed in a rolling mill that has a four-high configuration, i.e., two backup rolls and two work rolls. In this case, the contact stresses between the work roll and the backup roll are much higher than those at the interface between the strip and the work roll. The reason for this stems from the fact that the width of the area over which the backup roll and work roll surfaces come into contact is significantly smaller than the width of the area of contact between the work roll and sheet surfaces. Also, the sheet is typically put under a tensile stress which acts to reduce the normal contact stress required to achieve a desired reduction. Hence, backup roll surface wear and ultimately severe damage of the backup roll surface may result from crater rims (in the cases of the laser or electron beam technologies) or sharp cutting edges (in the case of the electric discharge technology) repeatedly indenting the backup roll surface during the rolling process.

Work roll steel is generally harder than the backup roll steel and hence the highest portions of the textured work roll surface may cut into the surface of the backup roll leading to the generation of small steel particles and recessions in the backup roll surface. With some simple engineering estimates, it is possible to demonstrate that, at least in the case of the annular crater morphology in FIG. 8 or asymmetric "hump" morphology in FIG. 10, the work roll texture will indent the backup roll surface under rolling process conditions which are commonly found in the aluminum industry. This first requires an estimate of the lubricant film thickness between the work roll and the backup roll surfaces to determine if the lubricant film separates the two surfaces or if the texture height exceeds the film thickness on the average. Under those conditions in which the work roll surface texture does indeed come into contact with the backup roll surface, it is then necessary to determine whether or not the associated contact stresses along the work roll/backup roll contact are large enough to promote backup roll surface damage. The following developments, while limited to the case of the annular crater morphology, such as shown in FIG. 3, may also be extended to the case of the hump morphology of FIG. 10.

The lubricant film thickness between the work roll and the backup roll can be estimated using the well-known Dowson and Higginson formula for isothermal line contacts using the following expression as found in "Elastohydrodynamic Lubrication" by D. Dowson and G. R. Higginson, Pergamon Press, London, 1966:

$$h_{min} = 2.65\left(\frac{R'G^{0.54}U^{0.7}}{W^{0.13}}\right) \quad (1)$$

where:

$a_{sw}=\sqrt{y_i\beta R_w}$; width of sheet/work roll contact (along rolling direction)

$u_b$, $u_w$; backup roll and work roll surface speeds, respectively, relative to contact region $w=\sigma_y(a_{sw}L_{sw})$; load on the work roll due to sheet deformation per unit length (along the roll axis and hence transverse to rolling direction)

$y_i$; initial sheet thickness prior to rolling $E_b$; Young's modulus of backup roll $E_w$; Young's modulus of work roll E'; effective Young's modulus $$\frac{1}{E'}=\frac{1}{2}\left(\frac{1-\nu_w^2}{E_w}+\frac{1-\nu_b^2}{E_b}\right)$$

; reciprocal of effective Young's modulus $G=\gamma E'$; dimensionless material parameter $L_{sw}$; unit length of rectangular contact patch (along roll axis and hence transverse to rolling direction) of sheet and work roll interface $L_{wb}$; unit length of rectangular contact patch (along roll axis and hence transverse to rolling direction) of work roll and backup roll interface $R_b$; radius of backup roll $R_w$; radius of work roll $$R'=\frac{R_wR_b}{R_w+R_b}$$

; effective roll radius $$U=\frac{\mu_o(u_w+u_b)}{2E'R'}$$

; dimensionless speed $$W=\frac{w}{E'R'L_{wb}}$$

; dimensionless load

β; sheet thickness reduction ratio

γ; pressure viscosity coefficient $\mu_o$; base viscosity of lubricant

ν; Poisson's ratio $\sigma_y$; tensile yield strength of sheet

The following material and process parameters, which are representative of many four-high rolling configurations in the aluminum industry, are substituted into Equation (1):

$u_w=u_b=7.64$ m/s $y_i=0.001$ m $E_w=E_b=207$ GPa $L_{sw}=0.0254$ m $L_{wb}=0.0254$ m $R_w=0.27$ m $R_b=0.64$ m

β=0.03

γ=14.5 $GPa^{-1}$ $\mu_o=2.7\times10^{-3}$ Pa.sec $\nu_w=\nu_b=0.33$ $\sigma_y=1.4\times10^8$ Pa (for aluminum alloy 2008)

where the values of the contact lengths $L_{sw}$ and $L_{wb}$ are chosen for the purpose of concept illustration only. Note that the percentage sheet thickness reduction ratio is simple β×100, or in the present situation, 3%.

The calculated quantities are thus:

$a_{sw}=0.0028$ m $w=1.0\times10^4$N

E'=232 GPa

G=3364

R'=0.19 m $U=4.7\times10^{-13}$ $W=8.9\times10^{-6}$ where the appropriate unit designation is "Pascal" for "Newton/meter$^2$" with the prefix "G" representing giga and which implies multiplication by "$10^9$."

Using the above values in Equation (1), the lubricant film thickness between the backup roll and work roll given by Equation (1) is $$h_{min}=0.43\ \mu m$$

It is evident that the crater rims carry most of the load since the film thickness $h_{min}$ is much smaller than a typical crater rim height (e.g., 3.0 μm to 10.0 μm) produced with either the laser or electron beam technologies. Hence, the majority of the craters on the work roll will come into direct contact with the backup roll surface. Since Equation (1) is appropriate for isothermal line contracts, it is likely that the estimate for $h_{min}$ will be even less due to thermal effects (from plastic heating of the sheet, interfacial friction, etc.) on the lubricant viscosity.

An estimate of the total pressure or normal contact stress carried by the crater rims is thus needed in order to explore the likelihood of work roll surface texture indentation of a backup roll surface. One must first calculate the width $a_{wb}$ of the rectangular contact area between the work roll and the backup roll surfaces, as shown in FIG. 6. This is accomplished using classical Hertzian contact theory, a discussion of which is found in "Contact Mechanics" by K. L. Johnson, Cambridge University Press, New York, 1985. For two elastic cylinders in contact under a normal load w per unit axial length, the resulting plane contact zone has a width of $a_{wb}$ along the rolling direction. Hence, $$a_{wb}=\begin{cases}\sqrt{\dfrac{16wR'}{\pi E'}}\\[2ex]\sqrt{\dfrac{16(1.0\times10^4\ \mathrm{N})(0.19\ \mathrm{m})}{\pi(232\times10^9\ \mathrm{Pa})}}\\[2ex]204.2\ \mu\mathrm{m}\end{cases}\tag{2}$$

where the numerical values have been taken from the previous list of process parameters and material properties.

In the hexagonal crater pattern shown in FIG. 3 (produced with the electron beam texturing technology), and schematically in FIG. 7, the unit cell is a parallelogram. Within each unit cell lies one complete crater. The area of a parallelogram $A_p$ is given by $$A_p=\begin{cases}\text{base}\times\text{height}\\[1ex]C_S^2\sin 60^\circ\end{cases}\tag{3}$$

where $C_s$ is the center-to-center spacing between adjacent craters in a single cell in the hexagonal pattern as indicated in FIG. 7. Thus, the percentage of area covered by the crater rim in a single unit cell, $\%A_{cr}$, may be expressed as $$\%A_{cr}=\frac{\pi(r_o^2-r_i^2)}{C_S^2\sin 60^\circ}\tag{4}$$

where $r_o$ and $r_i$ are the outer radius and inner radius of the crater, respectively. A typical crater produced with the electron beam roll texturing device has an outer radius, $r_o$, of 76.2 μm, a rim width of 25.4 μm, and hence an inner radius, $r_i$, of 50.8 μm. A typical center-to-center spacing, $C_s$, is 203 μm. The area of the crater rim is thus $10.1\times10^{-9}$ $m^2$, the area of a unit cell parallelogram, $A_p$, is $35.6\times10^{-9}$ $m^2$ and the percentage of area of a parallelogram cell covered by the crater rim, $\%A_{cr}$, is 28%. The number of craters "N" within a small rectangular area of length 0.025 m (along the roll axis and hence transverse to the rolling direction) and width $a_{wb}$=204.2 μm (as the previously calculated contact width in the rolling direction) along the work roll/backup roll contact region is given by $$N = \begin{cases} \dfrac{\text{Area of Contact}}{\text{Area of Paralle log ram}} \\ \dfrac{(0.0254\ \text{m})(2.04 \times 10^{-4}\ \text{m})}{35.6 \times 10^{-9}\ \text{m}^2} \\ 146 \end{cases} \tag{5}$$

where N has been rounded to the nearest integer value.

The total area, $A_T$, covered by all of the crater rims along a unit length is thus $$A_T = \begin{cases} \pi N(r_o^2 - r_i^2) \\ (\pi)(146)[(76.2 \times 10^{-6}\ \text{m})^2 - (50.8 \times 10^{-6}\ \text{m})^2] \\ 1.5 \times 10^{-6}\ \text{m}^2 \end{cases} \tag{6}$$

The average pressure, $p_A$, distributed across the crater rims along the sheet/work roll interface is therefore $$p_A = \begin{cases} \dfrac{1}{A_T}\left(\begin{array}{c}\text{Average Normal Contact}\\ \text{Stress Along Sheet/}\\ \text{Work Roll Interface}\end{array}\right)\left(\begin{array}{c}\text{Area of Contact}\\ \text{at Sheet/Work}\\ \text{Roll Interface}\end{array}\right) \\ \dfrac{(1.1\sigma_y)(L_{sw}\sqrt{y_i R_w \beta}\ )}{A_T} \\ \dfrac{(1.1 \times 1.4 \times 10^8\ \text{N/m}^2)((0.0254\ \text{m})\sqrt{10^{-3}\ \text{m} \cdot 0.27\ \text{m} \cdot 0.03}\ )}{1.5 \times 10^{-6}\ \text{m}^2} \\ 7.4\ \text{GPa} \end{cases} \tag{7}$$

It is appropriate to assume that the pressure, $p_A$, is transferred to the work roll/backup roll interface and hence onto those crater rims momentarily at that interface. The yield strength of a backup roll may be as high as 1.0 GPa. Hence, an estimate of the backup roll indentation pressure is 2.6 GPa since the indentation pressure is approximately 2.6 times the yield strength of the backup roll material. Obviously, a 7.4 GPa pressure on the crater rims exceeds the 2.6 GPa indentation pressure of the backup roll surface. Therefore, it is likely that a crater rim will indent the backup roll surface, and the real area of contact will extend beyond the total area covered by the craters even in situations where the percentage sheet thickness reduction ratio is 3%. With time, this will lead to severe damage of the backup roll surface. Such damage can only arrested by changing the backup roll and this leads to production downtime, increased process intensity, added manpower, and increased cost.

Substantial surface wear of a textured work roll occurs when the protruding rims or cutting edges of the work roll surface dislodge from the work roll surface during rolling. In the case of the annular crater morphology formed by the impact of a $CO_2$ laser beam, for example, the crater rim is formed by the rapid acceleration of a microscopic pool of molten metal onto the that portion of the ground surface of the roll that surrounds the central depression. The metal which solidifies on the roll surface (i.e. the crater rim) attaches itself to the local roll roughness which is typically a ground finish. The strength of this bond is dependent upon the adhesion of the solidified material to the roll surface. This bond may, in fact, be quite weak since the molten metal may not sufficiently "fill" the ground roll roughness. Hence, the crater rim can dislodge from the work roll surface when subjected to the reciprocating contact pressures in the roll bite. This causes a degradation of the textured work roll surface which ultimately requires roll redressing. The problems associated with adhesion of the molten material which solidifies to form the annular crater rim during $CO_2$ laser texturing of work rolls are discussed in U.S. Pat. No. 4,806,731, dated Feb. 21, 1989 to Bragard et al.

There is no possibility of forming a crater depression without a rim since melted material under the impinging beam flows radially out of a growing depression, with outward fluid velocities of melted material being primarily induced by a surface tension spatial gradient extending along the surface of a molten pool formed by the beam. This gradient is the product of a surface tension variation with temperature and a surface temperature spatial gradient. Variation in the surface tension gradient produces a shear stress which accelerates the surface of the molten material. The shear stress, $\sigma$, is related to the surface tension spatial gradient through the following relation:

$$\sigma = \frac{d\zeta}{dr} = -\zeta' \frac{dT}{dr}$$

where $\zeta'$ is the surface tension variation with temperature. The distribution of energy in a beam pulse typically decreases radially outwards from the pulse center and thus the local work roll surface temperature decreases radially outwards from the impingement point of the beam. By this equation, the surface tension thus increases radially outwards from the impingement point. Hence, shear stress on a layer of molten metal is significant enough to displace the melt to the banks of the depression, and the rapidity of the heating process overrides subsurface fluid motion and, hence, more material is carded radially outwards than can be replaced by any recirculating flow beneath outwardly flowing layers of molten work roll surface material. A buildup of material results, followed by rapid freezing of the material, thereby resulting in the formation of an annular rim or lip around the depression. A description of the surface melting and shearing effect during laser and electron beam processing of materials may be found in "Thermocapillary Convection in Materials Processing," by M. M. Chen, in Interdisciplinary Issues in Materials Processing and Manufacturing, S. K. Samanta, R. Komanduri et al eds. ASME Publications, (1987), pages 541–558.

The aforementioned melting and surface shearing process occurs both with and without a gas assist, although the gas assist will modify the maximum height of the molten fluid that is to ultimately form the solidified lip. If the velocity of the gas assist is made to be excessively high, a crater lip is still formed since the aforementioned surface shearing occurs as soon as a molten pool forms under the beam. In addition, a high velocity gas assist will tend to expel molten material from the evolving crater beneath the beam. A fraction of the expelled molten material can re-deposit onto the work roll surface and then solidify into numerous sharp cutting edges. The cutting edges from the re-deposited material will generate wear debris in heavy percentage sheet thickness reduction ratio rolling processes.

Another problem arises from the relative crater spacing along the work roll surface. In the rolling process, the work roll surface moves at a faster speed than the sheet surface prior to the neutral plane, at which the roll and the sheet surfaces have the same speed. After a sheet surface element passes the neutral plane, the surface element moves at a faster speed than the work roll surface. (This phenomena is discussed in detail in Applicants' earlier patent incorporated herein by reference.) If the reduction is generally less than about 5%, then there is minimal relative smearing action between the sheet and the roll surfaces and a nearly perfect imprint of the roll texture onto the sheet surface results. At heavier reductions, the craters in the work roll surface indent the sheet surface and smear the sheet surface toward the rolling direction prior to the time when a sheet surface element reaches the neutral plane; smeared tracks are thus formed on the sheet surface (i.e., forward smearing). After the sheet surface element passes through the neutral plane, the same action is repeated but in the opposite direction since the sheet surface speed exceeds the roll surface speed due to volume conservation of plastic deformation (backward smearing). The net effect of the backwards and forwards smearing action is the formation of short and narrow "tracks" on the sheet surface, and the sheet texture is thus significantly distorted.

FIGS. 9*a* and 9*b* of the drawings show the surface morphologies of two sheet surfaces of aluminum alloy 2008 which were rolled with a texture similar to the asymmetric hump texture in FIG. 10 at 35% and 60%, respectively, under otherwise identical rolling process conditions. In each case, the sheet surface textured does not faithfully represent the imprint of the work roll surface texture. This is especially evident in FIG. 9*b* where the sheet texture displays a substantial directional component due the fact that the humps in the work roll indent and plow the sheet rather than simply indent the sheet as was the case with the light reduction rolling process that produced the sheet surface shown in FIG. 4. Thus, a higher reduction in sheet thickness tends to elongate the crater impressions on the sheet surface, thereby forming long, smeared tracks since the craters generally lie along a helicoidal course on the work roll surface. As the percentage sheet thickness reduction ratio is increased, the tracks due to adjacent craters or humps may connect-up with one another since the average length of a single track due to a single texture element increases with increasing reduction and there is little control over crater placement or overall crater pattern on the roll surface during $CO_2$ laser texturing where external chopping of a continuous wave beam is involved. This leads to the formation of grooves in the sheet surface which, when taken collectively, form an anisotropic roughness. Hence, it is possible to start with a substantially non-directional texture (such as that shown in FIG. 3) on the work roll surface and end up with a roughness on the rolled sheet surface that has a significant directional component.

These track effects can cause the sheet surface to have a directional appearance such as that found on a ground surface finish or that of the grating texture shown in FIG. 28. Such a surface may in some instances be undesirable from a customer standpoint, especially in situations where the customer desires a quasi-isotropic sheet surface roughness, as the optical properties of such a surface are less dependent upon the direction from which the sheet surface is observed by the human eye and such a surface will tend to retain lubricant rather than freely channeling lubricant during a forming cycle.

In general, it can be concluded that the textures provided by the aforementioned $CO_2$ laser texturing process cannot be used in heavy reduction (i.e., equal to or greater than 15% thickness reduction) aluminum rolling processes. The reasons are as follows: (1) a high sheet thickness reduction ratio results in a high roll separation force. This enhances the tendency of the crater rims (or humps in the case of the asymmetric morphology shown in FIG. 10) to damage the backup roll surface due to the previously discussed contact stress mechanism, and thereby leads to premature wear of the crater rims; (2) if the annular craters are too close together (i.e. along the circumferential direction on the work roll surface), it is estimated that a 15% sheet thickness reduction may result in the formation of discrete smear tracks which, in situations involving substantially greater thickness reductions than the aforementioned 15%, may interconnect to form continuous tracks in the sheet surface. The interconnected tracks form "rough" bands, while on the surrounding (untextured) sheet surface, which is smeared by relatively flat areas of the roll, there appear smoother and narrower bands from the grinding process. FIG. 11 shows an aluminum alloy 2008 sheet surface rolled at 40% reduction with the annular crater roll surface morphology created by $CO_2$ laser texturing. The center-to-center crater separation is short enough to cause tracks to form on the sheet surface; (3) since the $CO_2$ laser beam is mechanically chopped with a serrated disk, it is not possible to precisely control the position of one crater relative to its neighbors, i.e., to produce hexagonal or square-shaped cells. This is currently only possible with either the electron beam technology, since this technology has been adapted from the rotogravure printing with an internally pulsed $CO_2$ wherein the active elements in the laser resonator are modulated with a radio frequency device. Additional details oil the application of electron beam technology to rotogravure printing may be found in "A Rapid Electron Beam Engraving Process for Engraving Metal Cylinders" by W. Boppel, *Optik,* Vol. 77, No. 2, (1987), pages 83–92; (4) the craters lips or humps produced with the $CO_2$ laser texturing process will lead to prohibitively high levels of wear debris generation during large sheet thickness reduction rolling processes. Excessive wear debris puts an added burden on the rolling mill oil filtration house and will ultimately lead to termination of the rolling process. Similar concerns can be raised about the electron beam textures.

The painted appearance of sheet material rolled with laser textured rolls is often objectionable to sheet customers in the automotive industry. The annular crater roll texture leads to an annular recession in the sheet surface, and the hump texture leads to a nearly circular depression in the sheet surface. In either case, the sheet surface depressions are surrounded by flat areas which serve as bearing areas through which the load from a forming tool is transferred to the sheet. The strains in pressworking operations may not be large enough to cause the depressions on the sheet to completely disappear from the sheet surface. The embossed sheet texture, therefore, may show through the painted finish giving the paint finish a background texture. This is often a basis for rejection of the formed sheet component, especially for luxury class automobiles. Discussion of a texture remnant after pressworking is found in Chapter 5 of "Optimierung der Oberflachenmikrogeometrie von Aluminiumfeinblech fur das Karosserieziehen" (Springer-Verlag, 1988). In English, the title is "Optimizing the Surface Microgeometry of Aluminum Sheet for Automotive Body Panel Drawing" by R. Balbach.

SUMMARY OF THE INVENTION

The present invention overcomes the disadvantages of temper rolling processes, in which only a small percentage sheet thickness reduction ratio, less than five percent, is allowed at slow rolling speeds, by permitting massive percentage sheet thickness reduction ratios at high speeds, i.e., percentage sheet thickness reduction ratios at or in excess of 55%, in a single and last stand of a rolling mill with the sheet traveling on the order of 2,000 feet per minute in making autobody sheet and 5,000 feet per minute in making can sheet. And, this is accomplished without the unmitigated generation of wear debris while substantially eliminating backup roll surface damage in rolling configurations with backup rolls and maintaining the necessary traction levels at the sheet/work roll interface and work roll/backup roll interface so as to avoid slippage along these interfaces. This is accomplished by superimposing onto a substantially smooth work roll surface, the roughness of which is in the range of 0.007 μm to 0.25 μm, a deterministic pattern of micron-sized craters, the solid rims of which are removed from the roll surface, leaving bowl-shaped depressions with substantially smooth entry regions or mouths. This work roll texture is best seen in the stylus-rendered topography, FIG. 12 of the accompanying drawings.

The craters are preferably formed in the work roll surface by a pulsed laser or electron beam device through the melting and shearing effect previously described. The beams of such devices create depressions in the work roll surface and a lip or rim around each depression which, in the present invention, is substantially removed by any one or more of known polishing techniques such as honing, lapping, belt polishing, grinding, and/or chemical polishing. In this manner, work roll material that might otherwise generate wear debris in the roll bite is removed before the work roll is used. Otherwise, wear debris becomes embedded in the sheet surface during rolling to create a very dirty rolled product that is not wanted by the customers of the manufacturer of the product. It should be noted that it is not possible to machine-off the crater rims with a standard diamond-tipped tool since the diamond tip will chemically degrade while machining steel.

After the rims are removed, the roll surface can be coated with a dense, hard material such as a chrome.

In taking the massive sheet thickness reductions in the present invention, in contrast to temper rolling or other light reduction rolling processes, the material of the sheet is forced to partially extrude into the bowl-like depressions provided on the work roll surface. As the sheet material is being extruded, it is smeared due to the difference in sheet and work roll surface speeds. The simultaneous actions of extrusion and smearing within the roll bite lead to the momentary and highly transitory formation of microscopic raised structures on the sheet surface which are formally referred to as "prows." During the course of prow formation, any excess lubricant entrapped by the depressions on the roll surface is forced to flow out of the recessions by the extruding sheet material. The excess lubricant therefore flows into the sheet/work roll interface and improves the tribological properties of the interface. As explained in detail hereinafter, a minute rear prow remains on the sheet surface after the above transitory prows disappear from the sheet surface. When the sheet is then used in a secondary forming operation, such as deep drawing, the remaining prows act as lubricant carriers as well as lubricant barriers along the sheet/die interface. The prows thus improve the tribological properties of secondary sheet forming processes by minimizing the undesirable effects of galling or adhesive metal transfer since metal-to-metal contact is substantially minimized.

The background surface of the sheet between the remaining prows is also smeared in the above high reduction process by the smooth work roll surface that exists between the depressions on the work roll surface to provide a substantially smooth, bright sheet surface between the prows.

The number and spacing of the roll craters is dependent upon the hardness and alloy of the material to be rolled, the amount of reduction in thickness to be taken, the speed at which the material will be rolled, the amount and type of coolant and lubrication provided, and the nature of the secondary forming process (such as drawing or stamping).

Traction between the work roll and the backup roll surfaces is assured by shearing the lubricant film and a momentary partial filling of the softer backup roll material into depressions on the work roll surface. The filling process is due to elastic deformation of the backup roll surface. Those regions of the backup roll surface that partially fill the work roll surface bowls serve as lips which carry the traction forces between the work roll and backup roll surface.

The prows that remain of the rolled sheet surface are smeared and eventually flattened into the surface during pressworking operations since they cannot support the normal forces transmitted to the sheet surface from a forming tool or die during all stages of a forming process. Hence, any texture which may remain on the sheet surface after a pressworking operation is much less likely to show through a paint finish than those textures due to the crater or hump morphologies.

It is therefore an objective of the invention to provide a bright sheet product both before and after it is painted by massively reducing the product in the last stand of a rolling mill.

Another objective of the invention is to provide a work roll surface that will reduce substantially the generation of wear debris such that massive reductions in the thickness of a rolled sheet can be taken by the roll in a single stand of a rolling mill without significant generation and embedding of debris material into the surface of the sheet being rolled.

Yet another objective of the invention is to provide a work roll surface texture that allows cold rolling to be accomplished without damaging backup rolls used with work rolls having the textures of the present invention and which prolongs the surface life of both the work roll surface and the backup roll surface.

It is yet another objective of the present invention to provide a work roll surface texture which will allow massive percentage sheet thickness reduction ratios in a single stand of a rolling process which are not otherwise possible with either a ground roll surface finish or the annular crater or asymmetric hump textures, and which will not lead to failure of the rolling process.

Another object of the invention is to provide a texture which not only carries lubricant into a sheet/tool interface, such as that which occurs in a stamping operation, but also serves to cause a lubricant film generated at that interface to persist to later stages of the process due to the barrier effect, as explained in detail hereinafter.

Yet, another objective of the invention is to provide autobody sheet products having a high distinctness of image provided by high specular reflection of light from a substantially smooth background surface of the sheet.

Another objective of the invention is to provide a substantially non-directional sheet surface texture which, after the sheet is formed into a component by any number of secondary forming processes, will not show through or otherwise be readily apparent under a paint finish applied to the component surface by an automobile manufacturer.

BRIEF DESCRIPTION OF THE DRAWINGS

The invention, along with its objectives and advantages, will be best understood from consideration of the following detailed description and accompanying drawings in which.

DETAILED DESCRIPTION OF A PREFERRED EMBODIMENT

Figure 1:
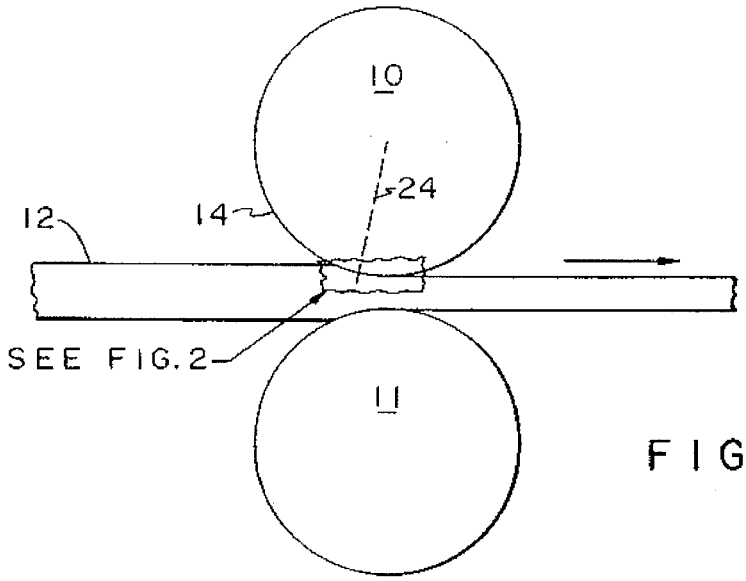
FIG. 1 is a diagrammatic view of two rotating work rolls of a rolling mill reducing the thickness of a metal material between them.
Figure 2:
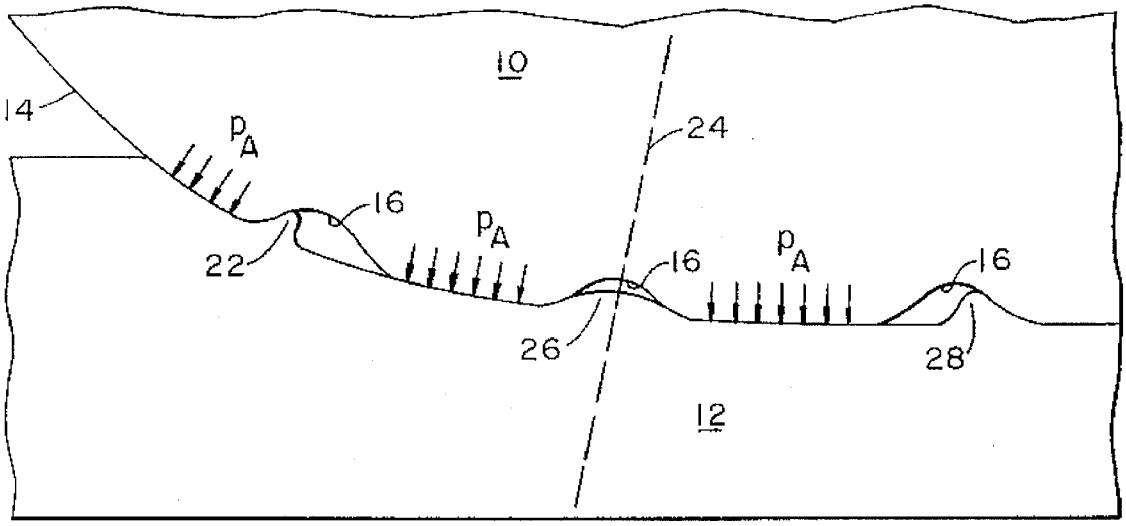
FIG. 2 is an enlarged partial section of the interface between the work roll and metal material of FIG. 1, the surface of the upper roll having minute, shallow, bowl-shaped depressions into which extrudes minute quantities of sheet surface material.

Referring now to FIG. 1 of the drawings, upper and lower rolls 10 and 11 of a rolling mill (not otherwise depicted) are shown in the process of reducing the thickness of a metal sheet 12. The upper roll has a working surface 14 that is provided with multiple, spaced apart, micron-sized, bowl-shaped depressions 16, three of which are depicted in FIG. 2 of the drawings, and which are also greatly enlarged for purposes of explanation. Before the depressions are provided in the surface 14 of one or more work rolls 10 and/or 11, surface(s) is (are) prepared in a manner that provides a very smooth finish, e.g., a finish on the order of 0.007 μm to 0.2 μm $R_a$ (arithmetic mean roughness). Measurement with the ISO roughness standard is adequate. Surface roughness standards are discussed in "Surface Texture Analysis, The Handbook" by L. Mummery, Hommelwerke, Germany, 1990. Such a surface provides the metal material reduced in thickness in the roll bite of FIG. 1 with a substantially smooth surface. Aesthetically, the result is a rolled product with a bright surface, with any smearing of the surface during rolling enhancing the overall brightness of the product as perceived by the human eye.

Figure 3:
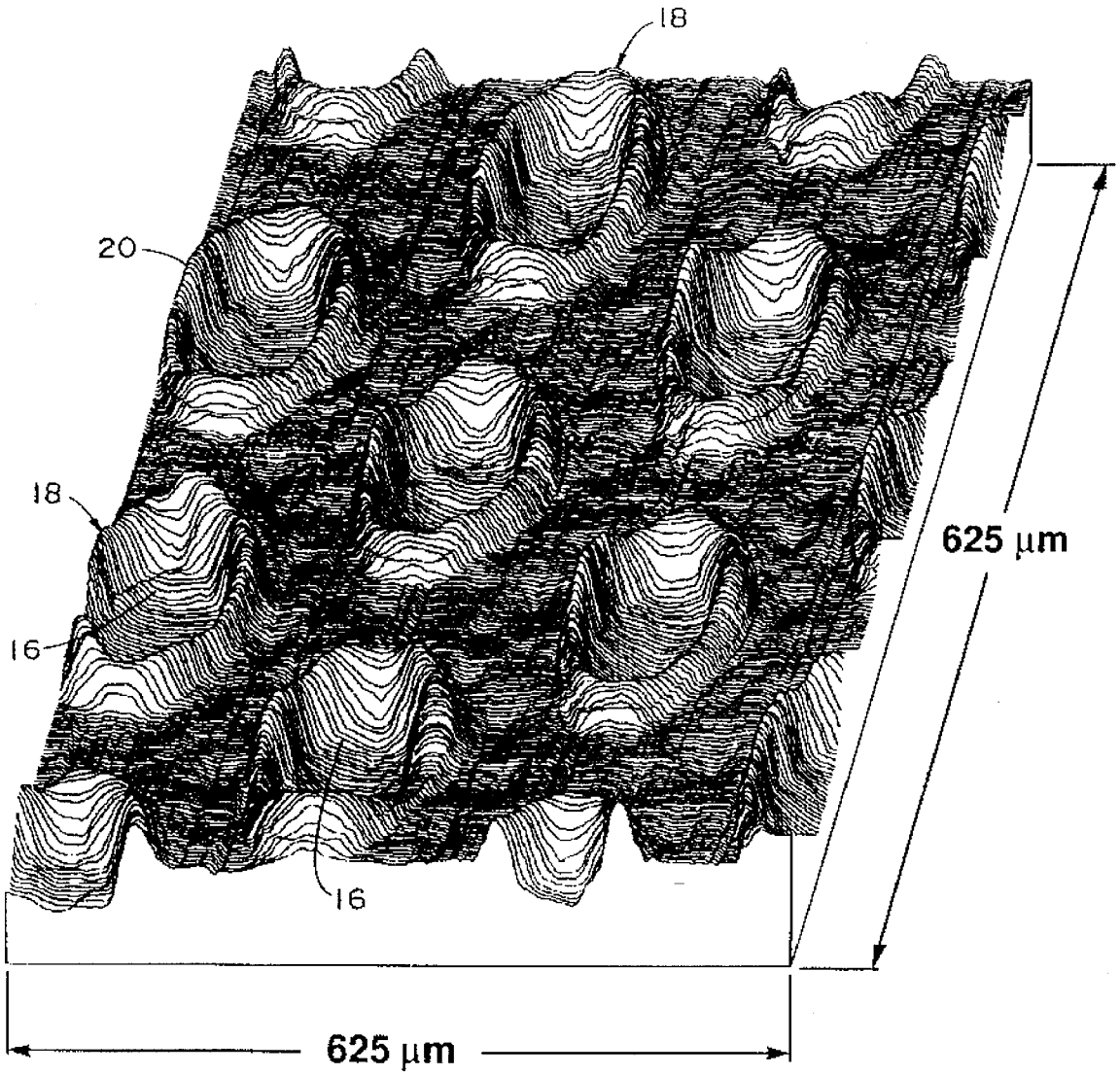
FIG. 3 (PRIOR ART)
FIG. 3 is a stylus-rendered topography of a portion of a work roll surface that displays the annular crater texture in an hexagonal array due to an electron beam texturing device.
Figure 7:
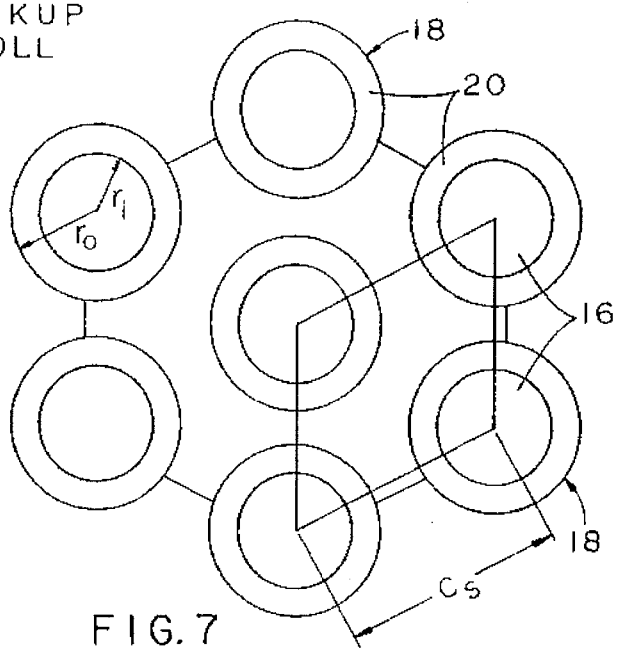
FIG. 7 is a diagrammatic view of an hexagonal crater pattern (such as that shown in FIG. 3) provided in the surface of a work roll by an electron beam device, the fundamental unit of which is a parallelogram.
Figure 8:
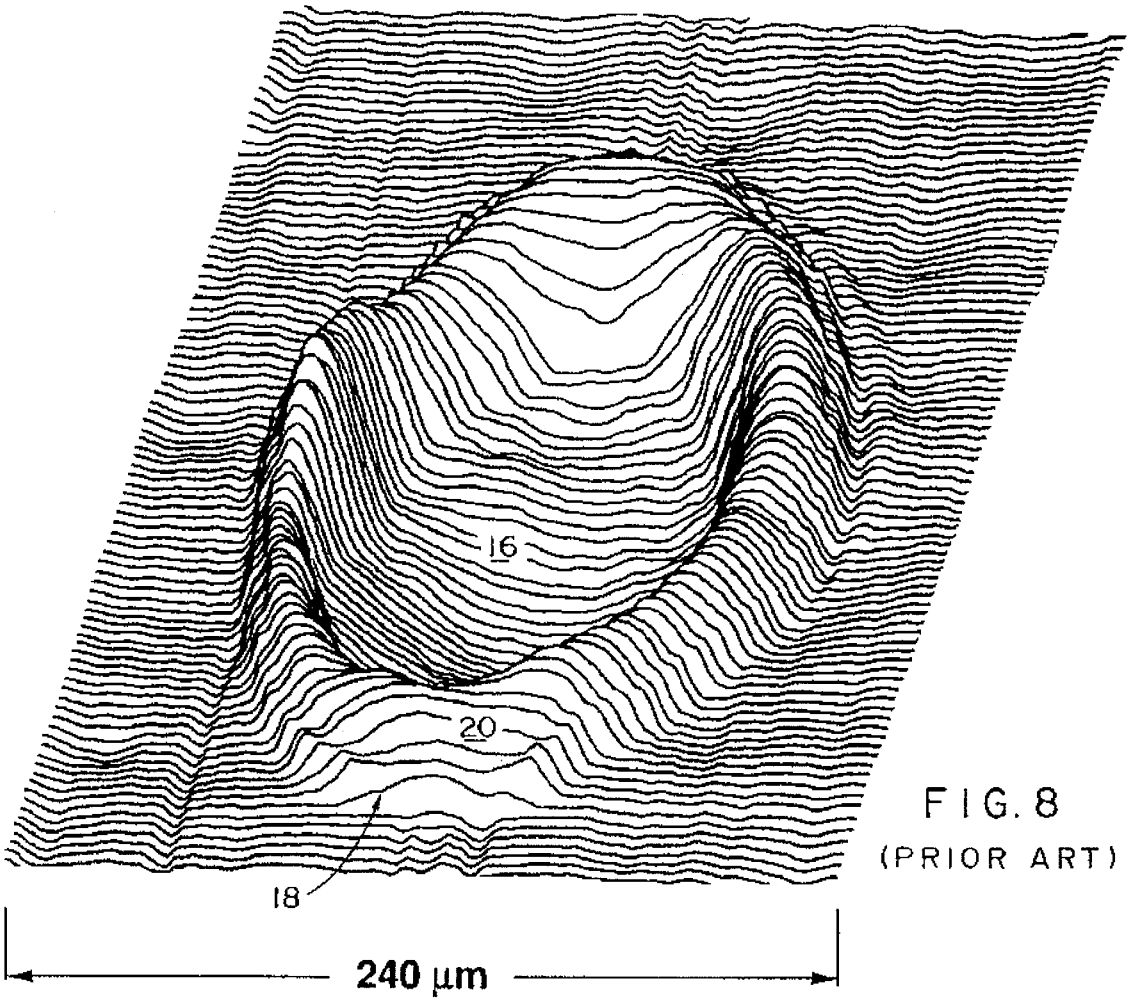
FIG. 8 (PRIOR ART)
FIG. 8 is a stylus-rendered topography of a single annular crater formed in the surface of a work roll by dual pulses from an electron beam texturing device.

As discussed below and as shown in FIGS. 3, 7 and 8, depressions 16 are formed when a focused energy beam impinges roll surface 14 to form craters 18, which include raised rim material 20 that surrounds each depression. The beam strikes the roll surface at normal incidence since the beam path is aligned with the roll axis.

Figure 4:
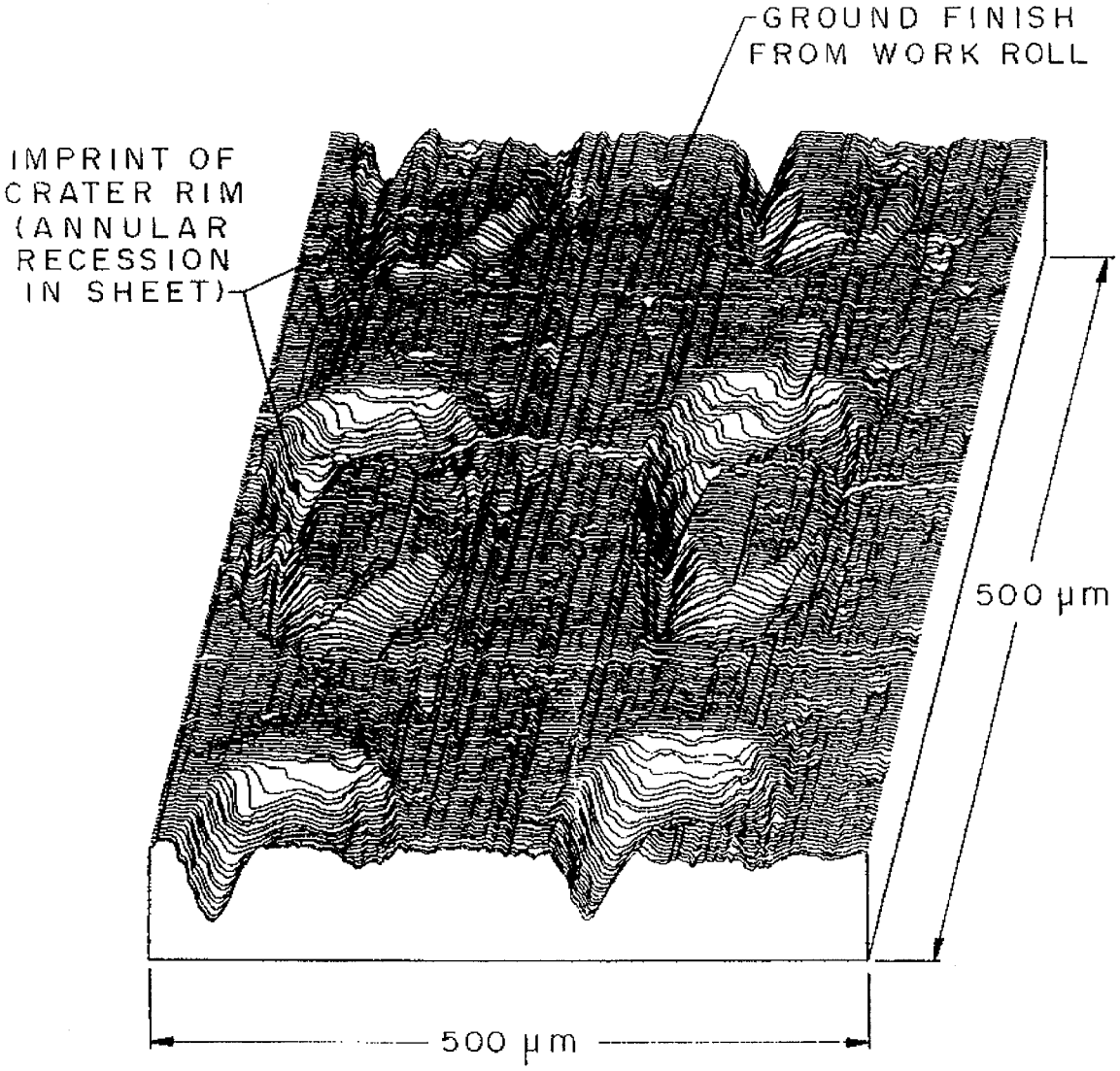
FIG. 4 is a stylus-rendered topography of an aluminum sheet surface embossed with a crater texture on a work roll surface during a light reduction rolling process.

FIG. 2 represents the interface between one work roll of the invention and one surface of a sheet being rolled by the work roll during a massive sheet thickness reduction rolling process, and is an enlarged section of the small "boxed" region in FIG. 1. The presence of the bowl-shaped depressions in the work roll surface along with the normal load exerted by the work roll surface on the sheet surface (denoted by $p_A$ in FIG. 2) during massive sheet thickness reduction rolling, as well as the kinematics of the roll bite, cause the sheet surface topography to undergo a series of changes within the roll bite prior to its exiting the roll bite. Forward prows 22 are shown in FIG. 2, which are microscopic, crescent-shaped, raised portions of sheet surface material, and are formed in the region of the interface that precedes the vicinity of the neutral plane of the roll bite, the neutral plane being designated by numeral 24 in the figures. Mounds 26 form on the sheet surface in the vicinity of the neutral plane. In the exit region, backward prows 28 form on the sheet surface and remain on the sheet as the final sheet surface texture. The transient nature of the sheet surface depicted in FIG. 2 is not due to the work roll surface texture embossing the sheet surface, as is the case with the sheet topography depicted in FIG. 4 and in Applicants' patent discussed earlier. Rather, microscopic quantities of sheet material are subjected to a combination of backwards extrusion into the bowls (due to the normal load exerted by the work roll surface on the sheet surface) and smearing of the backward extruded material due to the significant relative motion between the work roll surface and the sheet surface that occurs during massive sheet thickness reduction rolling.

A laser or electron beam device (not shown) is employed to produce craters 18 (see FIGS. 3 and 8) in the work roll surface, each crater being comprised of a central depression 16 and a raised, annular rim 20 that surrounds the depression. The beams of such devices precisely locate each crater on the roll surface and at a size and frequency of occurrence that are determined by the amount of the thickness reduction to be taken, the alloy and temper of the sheet 12 reduced in thickness, the type and temperature of coolant and lubricant employed in the reduction process, and the speed at which the reduction is taken. Generally, a typical depression depth in a work roll surface lies in the 0.4 μm–10.0 μm range for generally circular depressions having outer diameters which lie in the 50.0 μm–255 μm range.

Figure 9A:
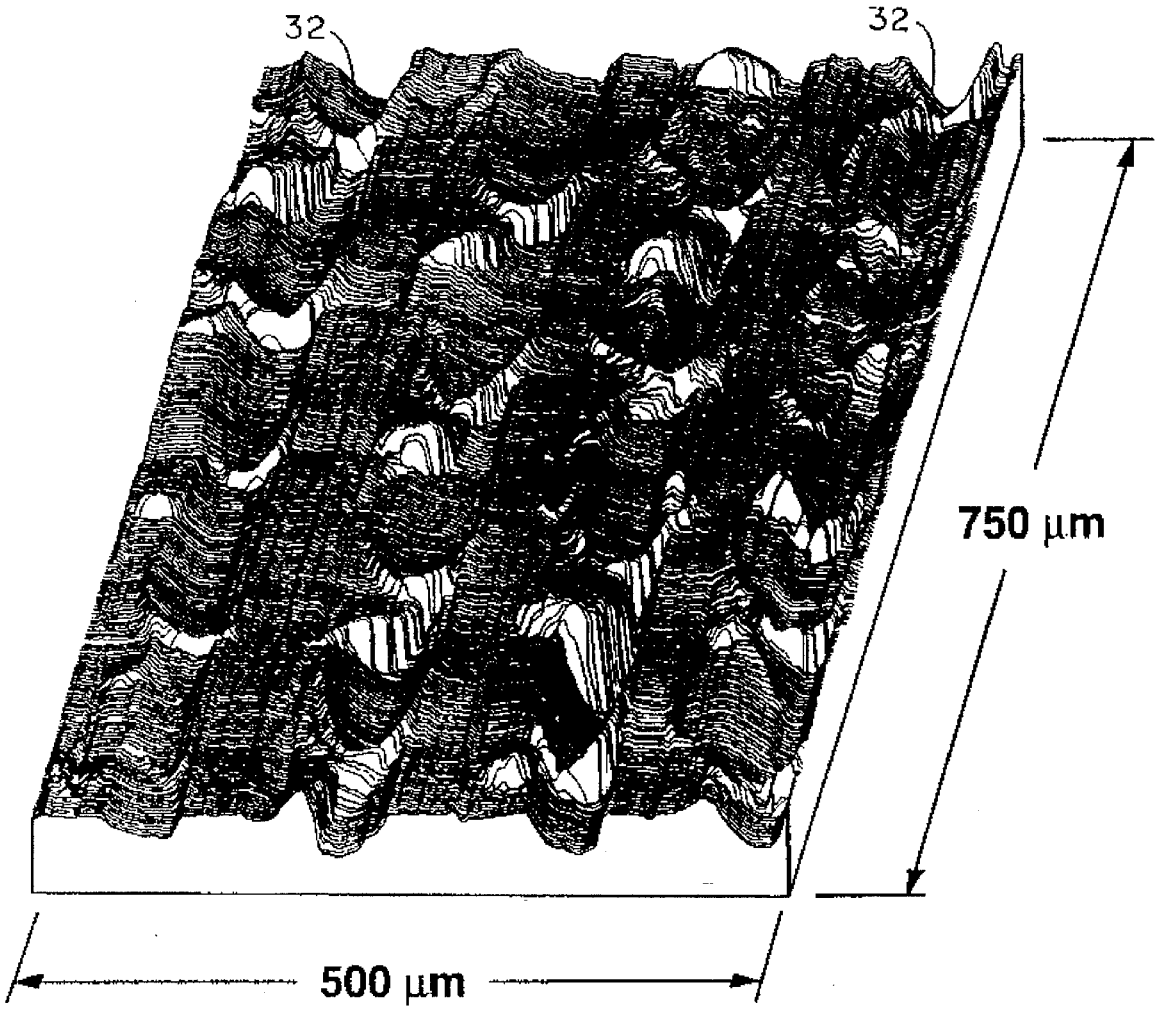
FIGS. 9*a* and *b* show surface smearing of two aluminum sheets rolled at 35% and 60% thickness reductions, respectively, by the asymmetric "hump" $CO_2$ laser texture shown in FIG. 10.
Figure 9B:
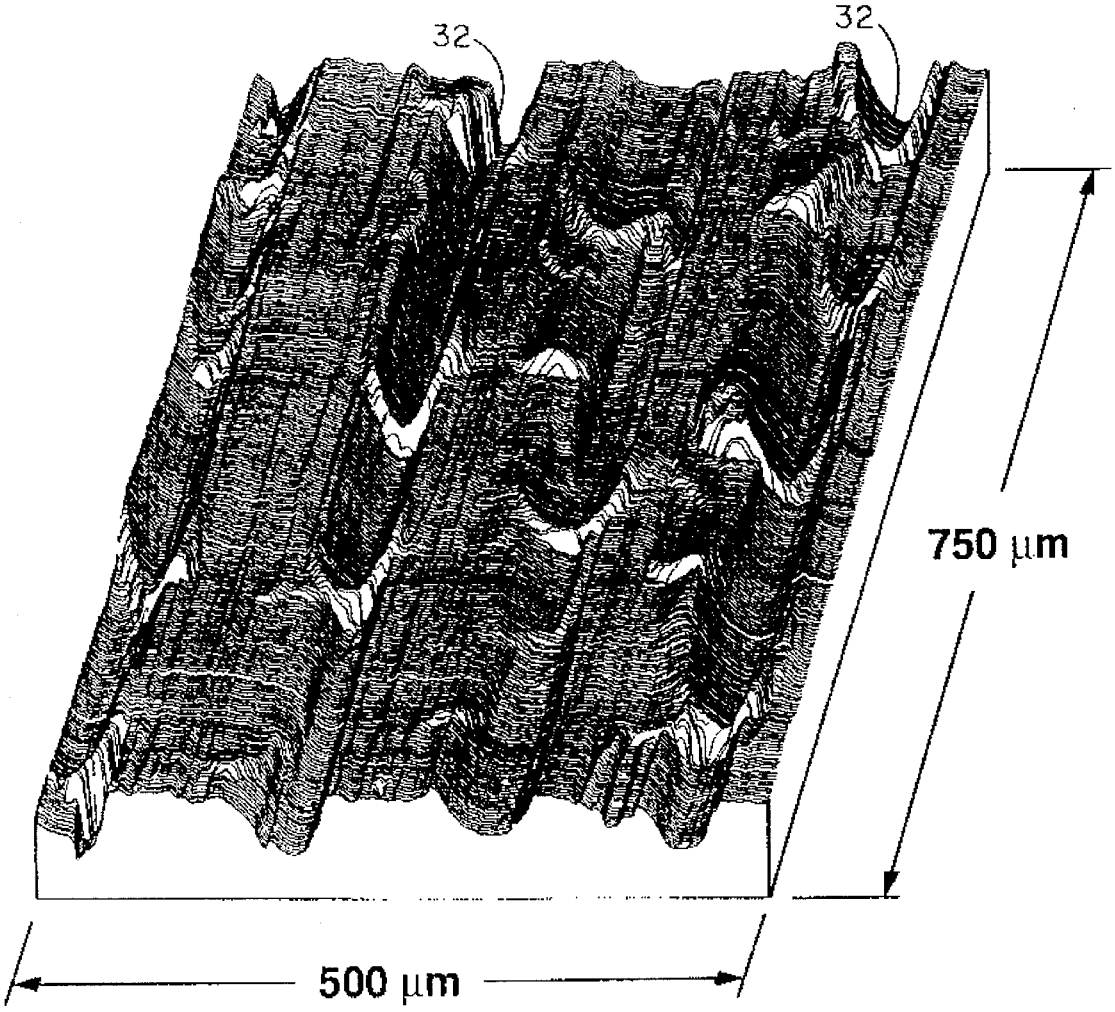
Figure 11:
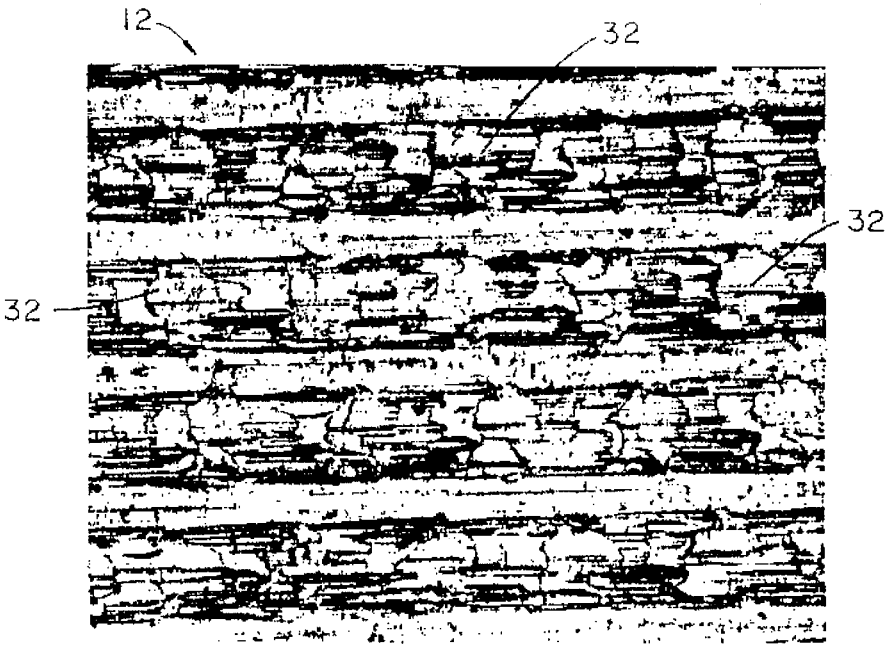
FIG. 11 is a photomicrograph of a 2008 aluminum alloy sheet (magnified 200 times) reduced in thickness by 40% using a work roll surface having the annular crater morphology of FIG. 8.
Figure 13:
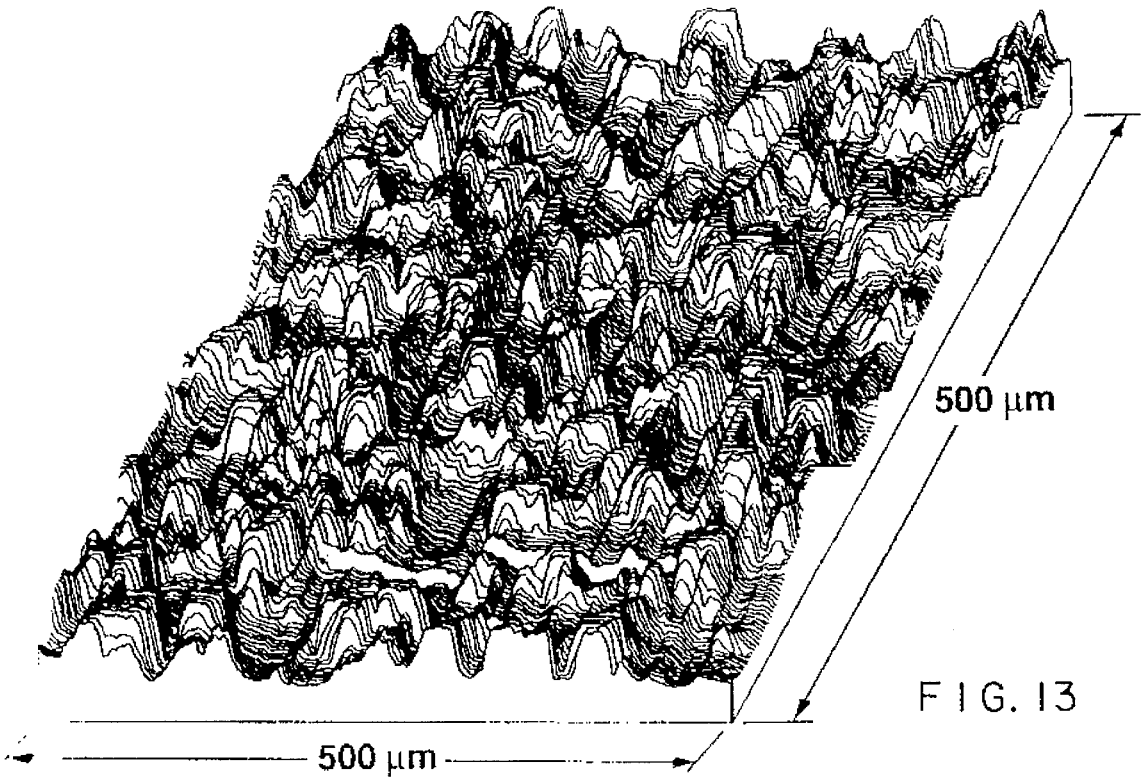
FIG. 13 is a stylus-rendered topography of a 2008 aluminum alloy sheet surface rolled in a light thickness reduction rolling process with a work roll textured by the electric discharge method.
Figure 12:
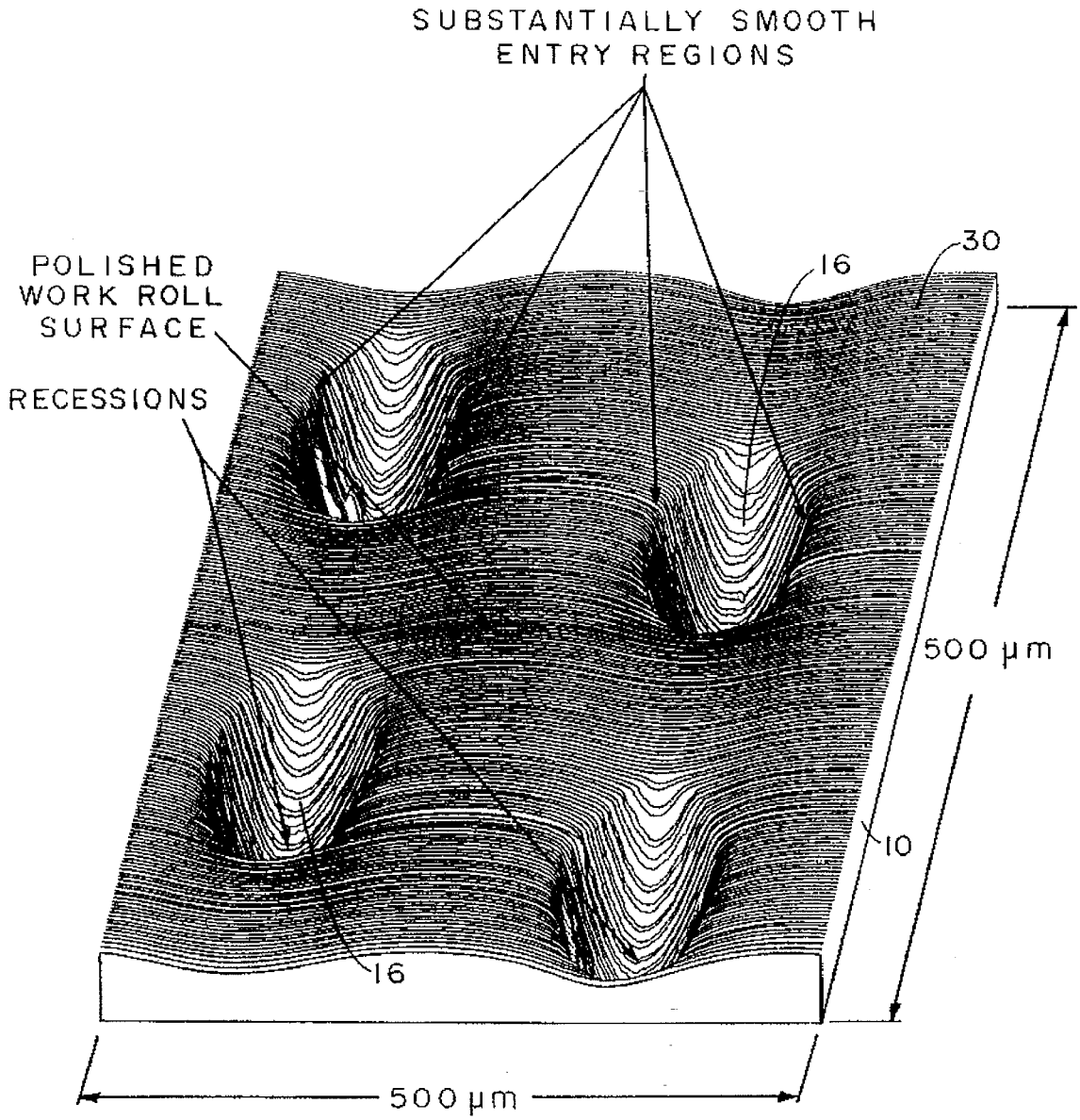
FIG. 12 is a stylus-rendered topography of smooth, bowl-like depressions in the surface of a steel work roll, with the crater rims removed to form smooth entry regions into the bowls.

When a pulsed laser beam having a Gaussian distribution of intensity about the beam center, or beam with a Gaussian current density emitted by an electron beam device strikes the roll surface normal in forming craters 18, the rims 20 of roll material form around depressions 16 (beneath the beam) since the energy density of the beam is significant enough to cause the roll material to melt. With such melting, subsequent rapid displacement of a portion of the melted metal to the periphery of the depression takes place due to surface shearing that results from the molten pool surface tension variation with temperature, as explained earlier. To prevent such rim material from breaking away from the roll surface during rolling, which contributes to the wear debris problem discussed above, the rim material is removed, resulting in the work roll surface topography in FIG. 12, and the roll surface is preferably coated with a hard dense material, such as a chrome, to provide a durable, long lasting wear surface. Removal of the rim material by polishing, for example, creates a substantially smooth surface finish 30 (FIG. 12) around depressions 16 in the work roll surface. Of special significance is the fact that the entry regions into the depressions shown in FIG. 12 are also smooth and thereby will not act as cutting edges to generate wear debris as sheet surface material is simultaneously extruded and smeared against the inner regions of the depression during massive reductions in sheet thickness. Since the background work roll surface finish 30 is also substantially smooth, as discussed earlier, the result of rolling with such a textured work roll is a bright strip or sheet product. With large sheet thickness reduction ratios, the resulting smearing process, as discussed earlier, enhances the brightness of the rolled product. Without removal of the material of the rims 20, wear debris generation and damage to backup rolls can result, as discussed above. In addition, under massive reductions in sheet thickness, the work roll surface crater configuration (FIG. 3) produces elongated parallel tracks 32 in the sheet surface that generally follow the rolling direction, as shown in FIGS. 9*a*, 9*b*, and 11. Such a surface is typically not wanted by the automotive sheet customer, as it is not an aesthetically pleasing surface and product and does not possess tribological properties that enhance forming of the sheet during secondary forming processes such as drawing and stamping.

In contrast thereto, with removal of rim material 20, and the formation of curved prows or raised mounds on the sheet surface during rolling processes involving massive percentage sheet thickness reduction ratios, as discussed below, a sheet product is produced that is substantially free of wear debris, with the life of the backup roll and the work roll surfaces substantially extended, while simultaneously producing a plate or sheet product that is desired by the customer.

Figure 19:
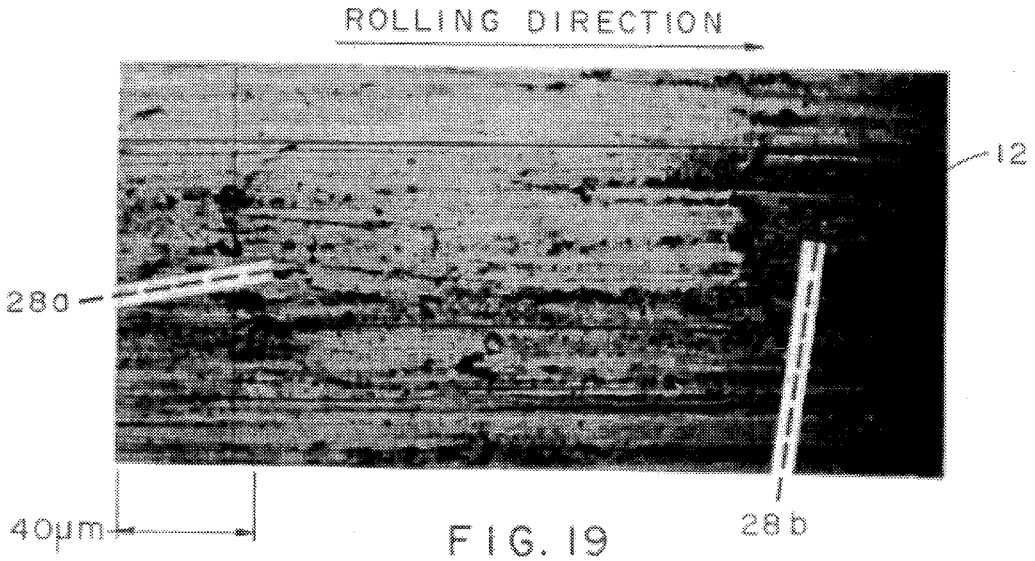
FIG. 19 is a photomicrograph of the backward prow material depicted in FIG. 18.
Figure 20:
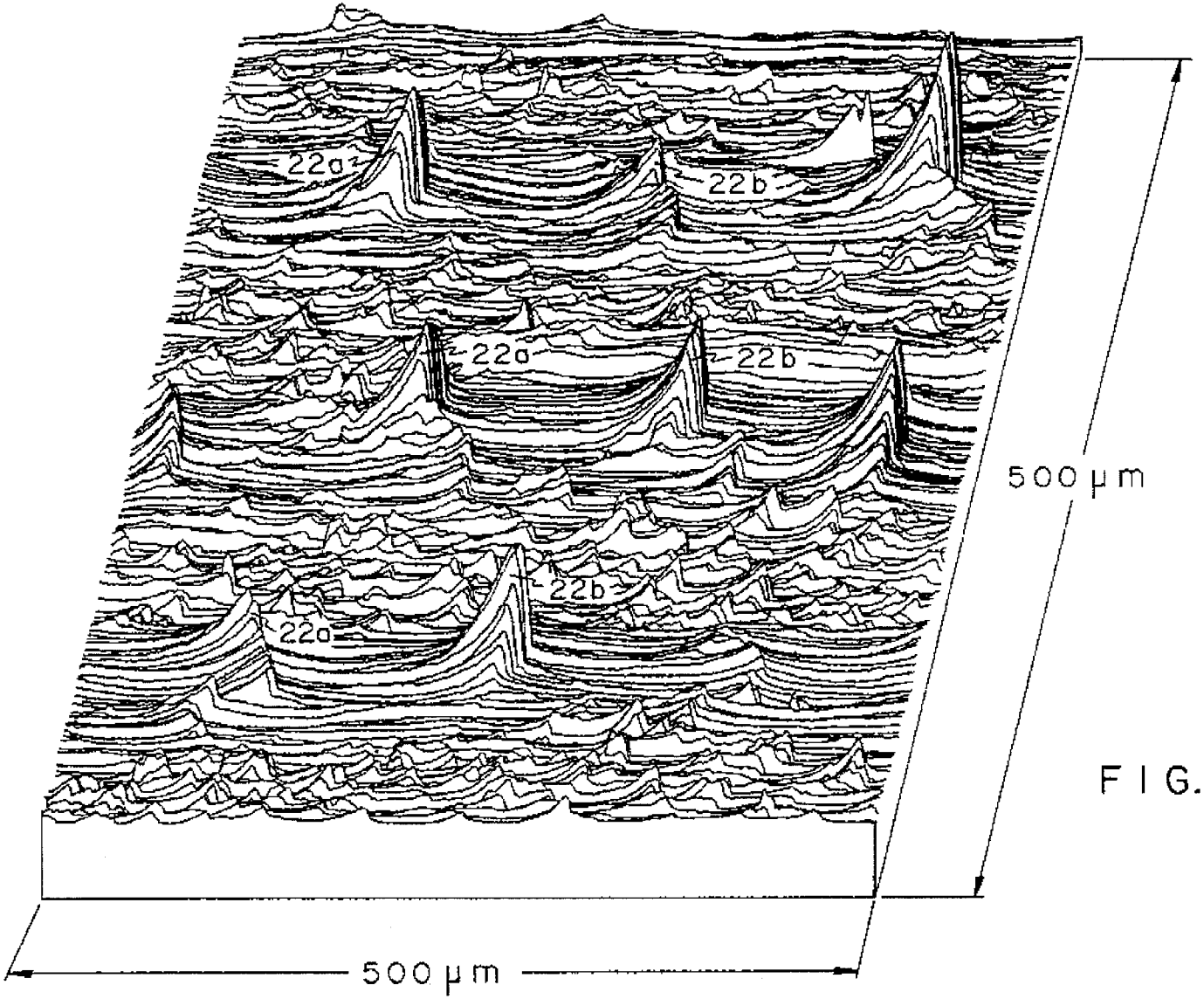
FIG. 20 is a stylus-rendered topography of a representative sheet surface area containing the forward prows shown in FIGS. 14 and 15.
Figure 21:
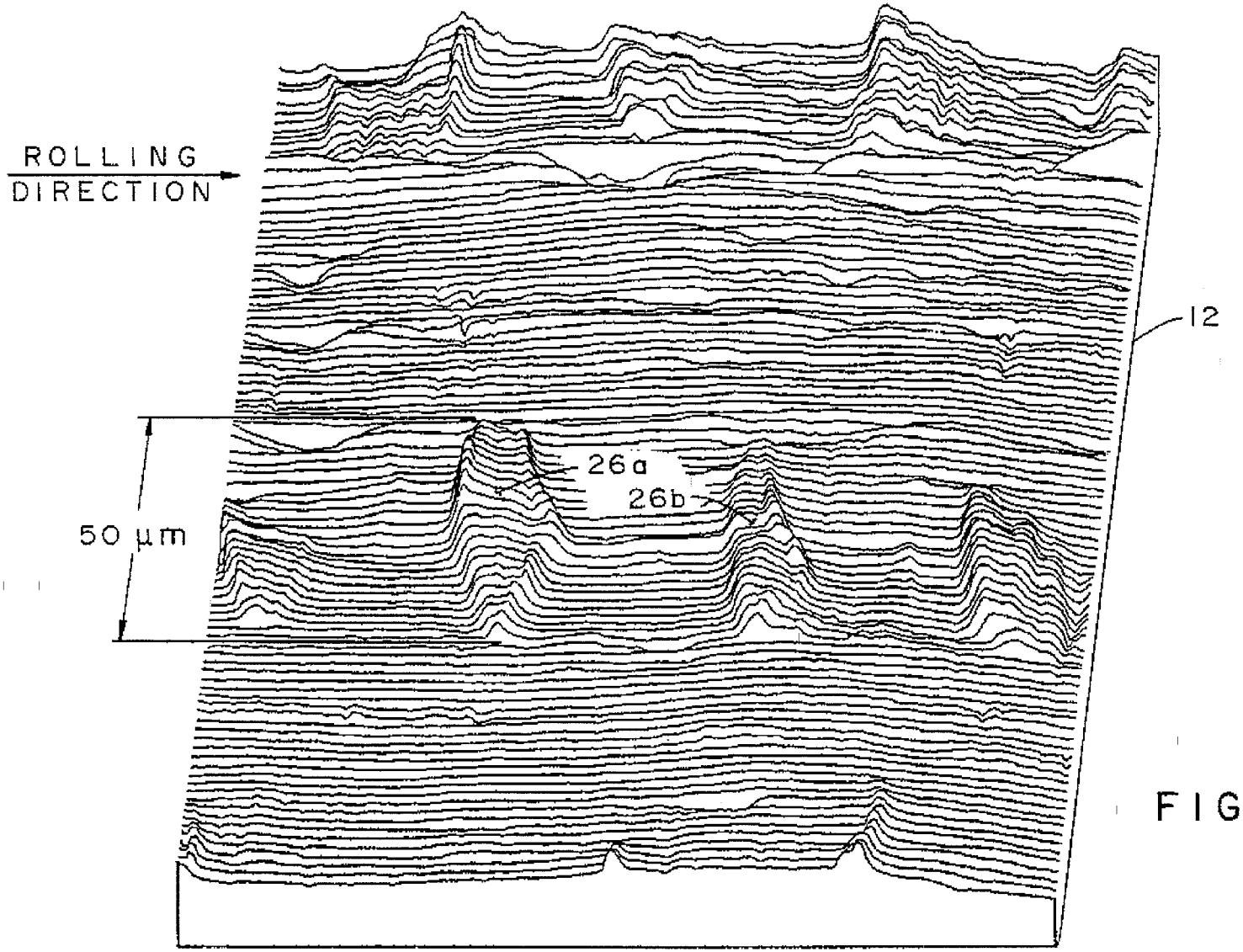
FIG. 21 is a stylus-rendered topography of a representative sheet surface area containing mounds similar to those shown in FIGS. 16 and 17.
Figure 22:
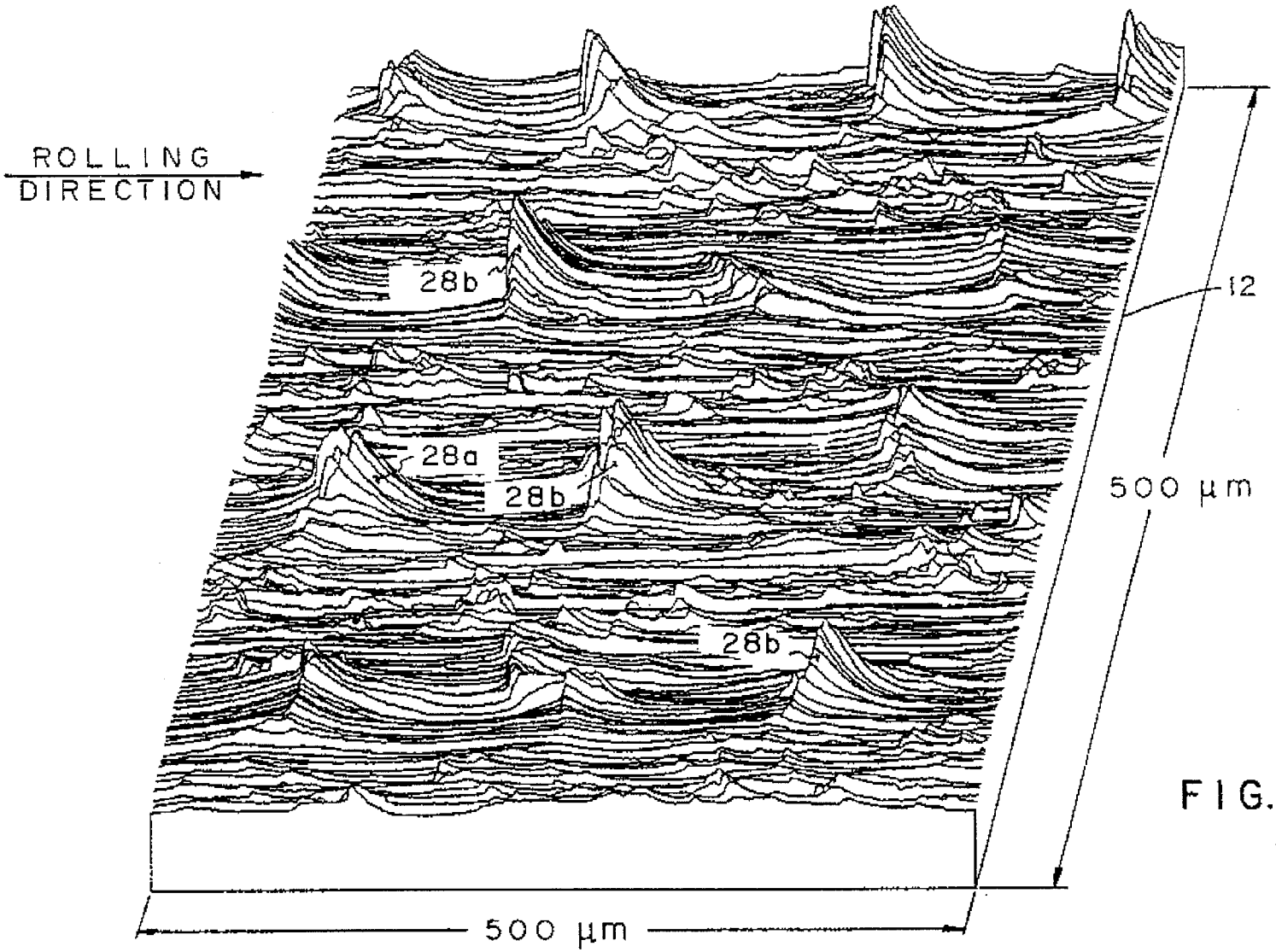
FIG. 22 is a stylus-rendered topography of a representative sheet surface area containing backward prows similar to those shown in FIGS. 18 and 19.

FIGS. 14, 16, 18 and 20 through 22 track a microscopic portion of a sheet surface rolled with the work roll surface texture in FIG. 12 during a massive sheet thickness reduction rolling operation in a final stand. These Figures depict the most significant changes that occur in the sheet surface at three selected times caused by the same two depressions (now identified as 16*a* and *b*) in the work roll surface as the depressions move from the entry region to the exit region in the roll bite, in conjunction with the influences of the normal load of the work roll on the sheet, and the kinematics of the roll bite, as the sheet passes through the roll bite. FIGS. 15, 17 and 19 are photomicrographs of representative sections of a sheet surface which depict sheet surface texture changes occurring at those stages of the rolling process shown in FIGS. 14, 16 and 18. FIGS. 20, 21 and 22 are stylus-rendered topographies of sheet surface texture elements similar to those shown in FIGS. 15, 17 and 19, respectively. FIGS. 14 to 22 capture the highly transient nature of the sheet surface roughness, as it passes through the roll bite where at least one work roll surface has been textured with microscopic depressions (FIG. 12) and finished using the method of the invention.

Figure 14:
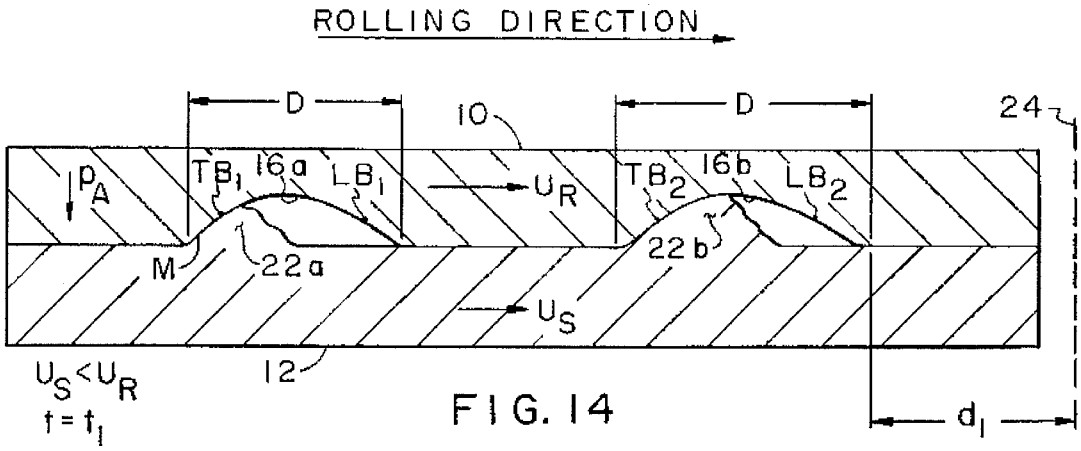
FIG. 14 is an enlarged partial section of the interface between the work roll and sheet surface of FIGS. 1 and 2 showing further details of forward prow formation on the sheet surface using the method of the invention (prior to the time when the partial section reaches the neutral plane in a roll bite, after which a backward prow is formed)
Figure 15:
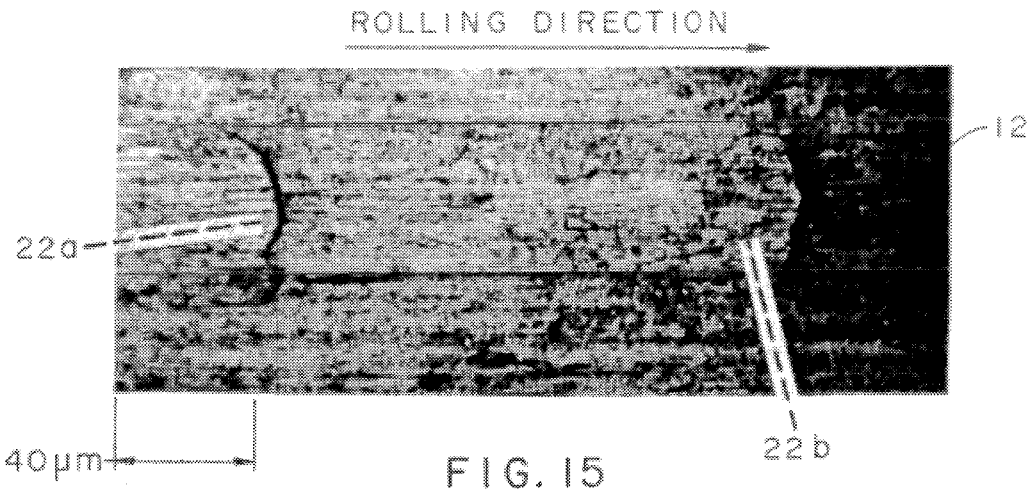
FIG. 15 is a photomicrograph of the forward prows in FIG. 14 magnified at 425 times.

In FIG. 14, the two roll surface depressions 16*a* and *b* created in accordance with the invention are loaded (at an initial time $t_1$) against the surface of sheet 12 by a normal load, $p_A$, prior to reaching neutral plane 24 within the roll bite. The neutral plane is also denoted by a vertically disposed dash line 24, which is at the extreme right in FIG. 14. The leading edge of the bank of depression 16*b*, which is denoted to be $LB_2$ in FIG. 14, is at a distance, $d_1$, from the neutral plane. The bank of the depression is defined as a surface ring of revolution, of small width, just below the mouth or entry region of and hence within the depression. This is the region along which contact with any extruded surface material is likely to occur. The region of contact between the depression bank and the extruded sheet surface material may be thought of as approximating a sectorial area or solid triangle for which the sum of the angles exceeds 180°. The diameter of each depression 16 is denoted by "D" in FIG. 14 although in practice there may be a slight distribution in the diameters within an array of roll surface depressions because of a variety of conditions that exist during the time when the roll is textured. These include fluctuations in the pulse energy density of the forming beam, beam focusing, machine tool vibration, irregular absorption of beam energy by alloying agents within the roll surface, related control electronics used to texture the work roll, etc. The normal load and the velocity difference between work roll and sheet surfaces cause a small amount of sheet surface material to partially flow or extrude into depressions 16*a* and *b*, as previously indicated. As a result of this normal pressure and the fact that the sheet surface speed is less than the roll surface speed, two forward prows 22*a* and *b* are formed along the trailing regions of the banks of depressions 16*a* and *b*, which banks are referred to in FIG. 14 as $TB_1$ and $TB_2$.

A simple understanding of prow formation may be achieved with the following analogy. Point M of depression 16*a* in FIG. 14 lies on the trailing section of the bank of depression 16*a*; this inclined bank is similar to the more familiar inclined surface of a water ski, although the water ski surface lacks the lateral curvature of the bank of the depression. When a person rides on water skis, the skis are typically inclined at a small angle relative to the surface of the water in front of the skier and this inclination along with his forward velocity create an accumulation or crest of water beneath his skis. If one follows this water crest with time while following the motion of the skier, one will find that it is simply a traveling wave. The wave may grow in intensity if the skier hits a region of the water surface in which the water velocity vigorously opposes the direction of his motion, such as might occur when a boat passes parallel to his direction. On the other hand, the wave may decrease in intensity if the skier hits a region of the water surface where the water is vigorously moving in his direction. Each prow, therefore, may be considered a solid or plastic wave, formed by partial backwards extrusion of a microscopic portion of sheet surface material into a roll surface depression, such extrusion occurring primarily along the trailing edge of the bank of the depression which has not yet reached neutral plane 24, see again FIG. 14. The sheet surface material, which partially fills the depression, is smeared in the rolling direction as it is extruded. This is due to the relative surface motion between the roll and the sheet surfaces prior to the time when the partially filled depression passes through the neutral plane.

FIG. 15 is a photomicrograph at 425× magnification that shows the prow-texture on a 2008 aluminum alloy sheet surface, such texture resulting from the partial backwards extrusion mechanism depicted in FIG. 14. There are two forward prows 22*a* and *b* shown in FIGS. 14 and 15. Each prow has a "crescent" morphology, as seen in FIG. 15. The distance between the prow edges corresponds to the center-to-center separation between the two depressions 16*a* and *b* in the roll surface which formed the prows (FIG. 14). The convex edges of the prows face in the rolling direction. Hence, the inner or concave edges of the prows face towards the entry point of the roll bite. There is an inclined end portion of material which raises to form the convex edge of a prow. Hence, if one were to climb from left to fight along the center of this incline, i.e., from left to right along a forward prow in FIG. 15, one would be climbing an incline which curves in each lateral direction, i.e., in the two directions that are normal to the rolling direction, and which rapidly falls off along the convex edge of the prow. This is better depicted in FIG. 20 which is a stylus-rendered topography of a representative area of the surface shown in FIG. 15. The prows are similar to water waves on the surface of the oceans. Also, the lateral curvature of the prows is evident. The height of the prows is in the 0.25 μm–3.0 μm range. The accumulation of metal which results in prow formation is due to smearing of extruded sheet material by a sectorial area of the trailing edge of the depression bank. The crescent geometry of the prows of FIG. 20, which appears to oppose that of the geometry of the depressions, results from two factors: (a) metal only partially extrudes into a depression and forms a plastic wave which is stationary relative to the depression, and (b) the greatest "pushing force" that the metal feels, as it flows into the depression, comes from the trailing edge of the bank of the depression.

At a later time $t_2>t_1$, i.e., in FIG. 16, the sheet and work roll surfaces that comprised the interface depicted in FIG. 14 leave the entry plane and move toward the vicinity of the neutral plane 24, although they reach the vicinity of the neutral plane at slightly different times due to the aforementioned smearing effect that causes the sheet surface to slide over the roll surface. Hence, prows 22*a* and *b* are subsequently smeared toward the exit region by non-textured regions 30 on the roll surface and eventually flattened into the sheet surface prior to the time when the sheet surface reaches the vicinity of the neutral plane. There is a small zone surrounding the neutral plane where the sheet and roll surface speeds are nearly identical, i.e., the vicinity of neutral plane 24. Hence, an observer riding with the roll surface in the vicinity of depressions 16*a* and *b* would see the sheet surface momentarily at, or very nearly at his own speed. Under these conditions, the relative smearing of the sheet surface is negligible, thereby leaving only the influence of the normal pressure on the sheet surface imposed through the work roll surface. This normal pressure, then, forces sheet metal to substantially extrude into the depressions 16*a* and *b* in the form of mounds 26*a* and *b* much the same way that the seal of a Notary Public embosses a legal document. A theoretical calculation of the normal load during rolling predicts that the normal load on the sheet surface is highest in the vicinity of the neutral plane. This, then, is the reason for the more-uniform "partial-filling" of the depressions with the sheet material near the neutral plane and subsequent formation of the mounds. The calculation of normal loads during rolling is discussed in "Theory of Plasticity" by J. Chakrabarty, Chapter 7, McGraw-Hill, (1987), pages 551–574.

Figure 16:
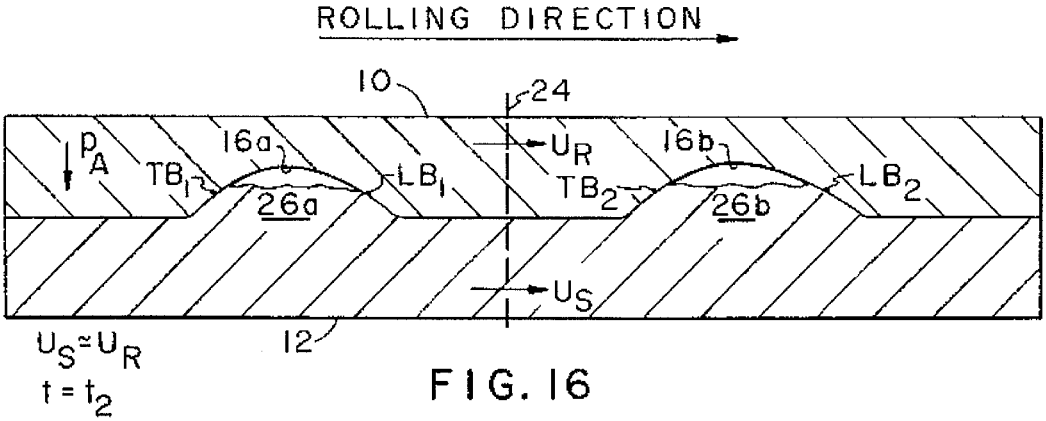
FIG. 16 is an enlarged partial section of the interface between the work roll and sheet surfaces after the original two work roll surface depressions in FIG. 14 have moved into the vicinity of the neutral plane in which the forward prows of FIGS. 14 and 15 have been smeared and flattened-out with sheet surface material undergoing further plastic deformation in the process of partially filling the two depressions in the work roll surface to become mounds.
Figure 17:
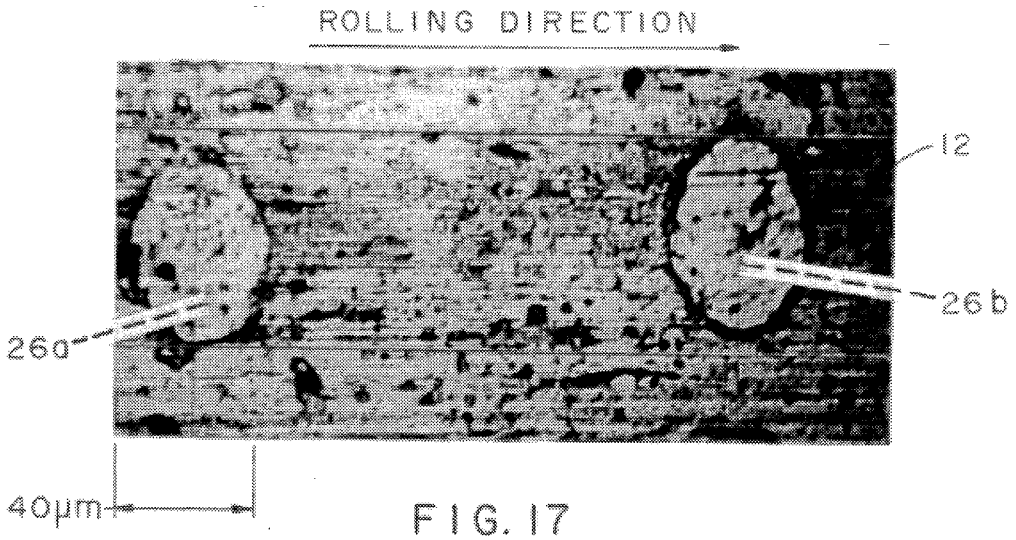
FIG. 17 is a photomicrograph of the metal mounds formed as the sheet passes through the neutral plane, magnified 425 times.

FIG. 17 is a photomicrograph at 425 times magnification which shows a set of the microscopic mounds on the sheet surface formed by the process described in FIG. 16. FIG. 21 is a stylus-rendered topography of a representative area of the surface shown in FIG. 17.

After work roll surface depressions 16*a* and *b* pass through the vicinity of neutral plane 24 of FIG. 16, the sheet surface speed begins to exceed the roll surface speed due to volume constancy of plastic deformation and mounds 26*a* and *b* are consequently flattened back into the sheet surface. Hence, the sheet surface mounds, formed as the sheet passes through the vicinity of the neutral plane and into the vicinity of the exit region, are then smeared by the leading edges of the banks $LB_1$ and $LB_2$ of depressions 16*a* and *b*, respectively, as seen in FIG. 16, as sheet 12 moves faster than roll 10, the mounds then subsequently being flattened.

Figure 18:
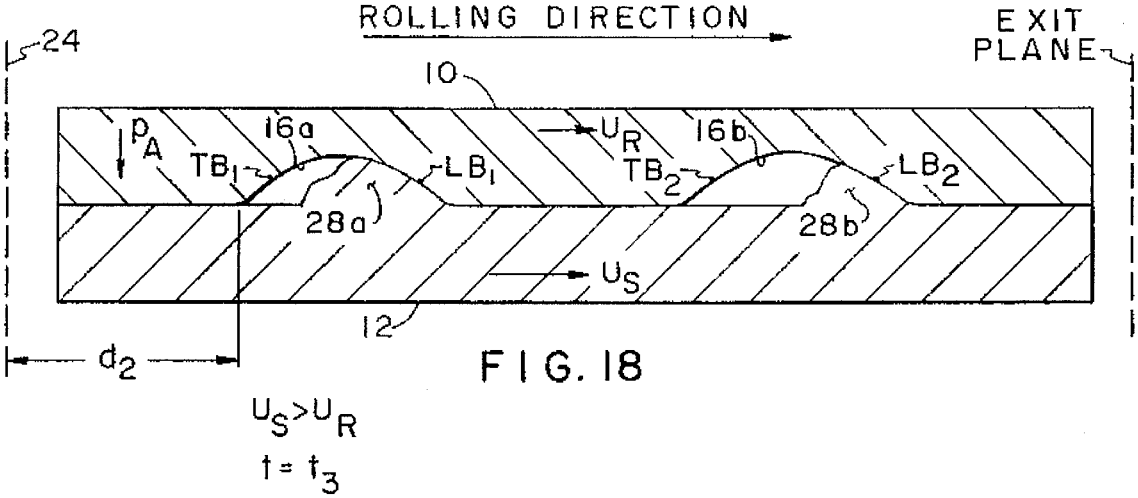
FIG. 18 shows the sheet surface in a position beyond the neutral plane in the roll bite after the original two work roll surface depressions in FIG. 14 have moved into the vicinity of the exit plane in the roll bite, with the mounds of FIGS. 16 and 17 having been flattened out and the sheet surface material undergoing further plastic deformation in the process of partially filling the two depressions in the work roll surface to become backward prows.

As the work roll surface depressions 16*a* and *b* move into the exit region and arrive in the vicinity of the exit region shown in FIG. 18 just after the time when the section of sheet shown in FIG. 18 arrives in this same region, backward prows 28*a* and *b* are formed on the sheet surface as shown in FIG. 18. FIG. 19 is a 425× photomicrograph of an aluminum sheet surface with backward prows 28*a* and *b* formed by the mechanism of FIG. 18. The convex edge of each forward prow faces toward the neutral plane, and hence the concave edge of each forward prow faces toward the roll bite exit plane at the extreme right in FIG. 19.

Figure 23:
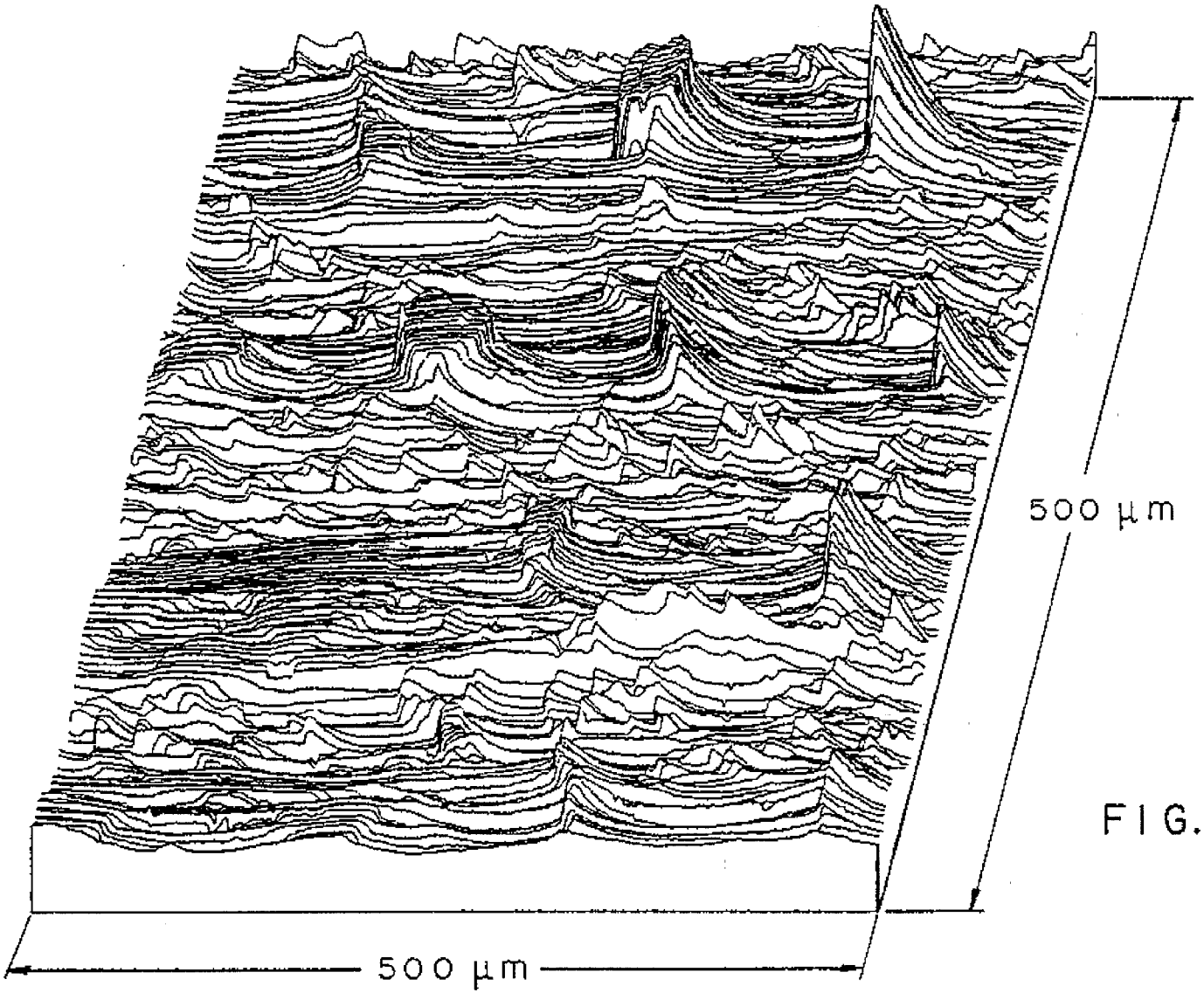
FIG. 23 shows the relative size of mounds formed on a section of a sheet surface which is in the region of the neutral plane of the roll bite and backward prows formed on an adjacent section of the same sheet surface which has crossed the neutral plane but which has not yet reached the exit plane.

FIG. 22 is a stylus-rendered topography of a representative area of the surface shown in FIG. 19 that contains forward prows 22*a* and *b* formed by the mechanism depicted in FIG. 18. FIG. 23 shows a stylus-rendered topography of a sheet surface rolled with the method of the present invention where the rolling process has been interrupted. Mounds formed on the sheet surface in the vicinity of the neutral plane are shown along with the forward prows that are formed on the sheet surface as the sheet enters the vicinity of the exit region. FIG. 23 further demonstrates the transient nature of the sheet surface topography during rolling at massive sheet thickness reductions, with at least one work roll textured with the topography in FIG. 12.

Therefore, the sheet surface will have the forward prow texture of FIGS. 22 and 23 upon exiting the roll bite.

Figure 24:
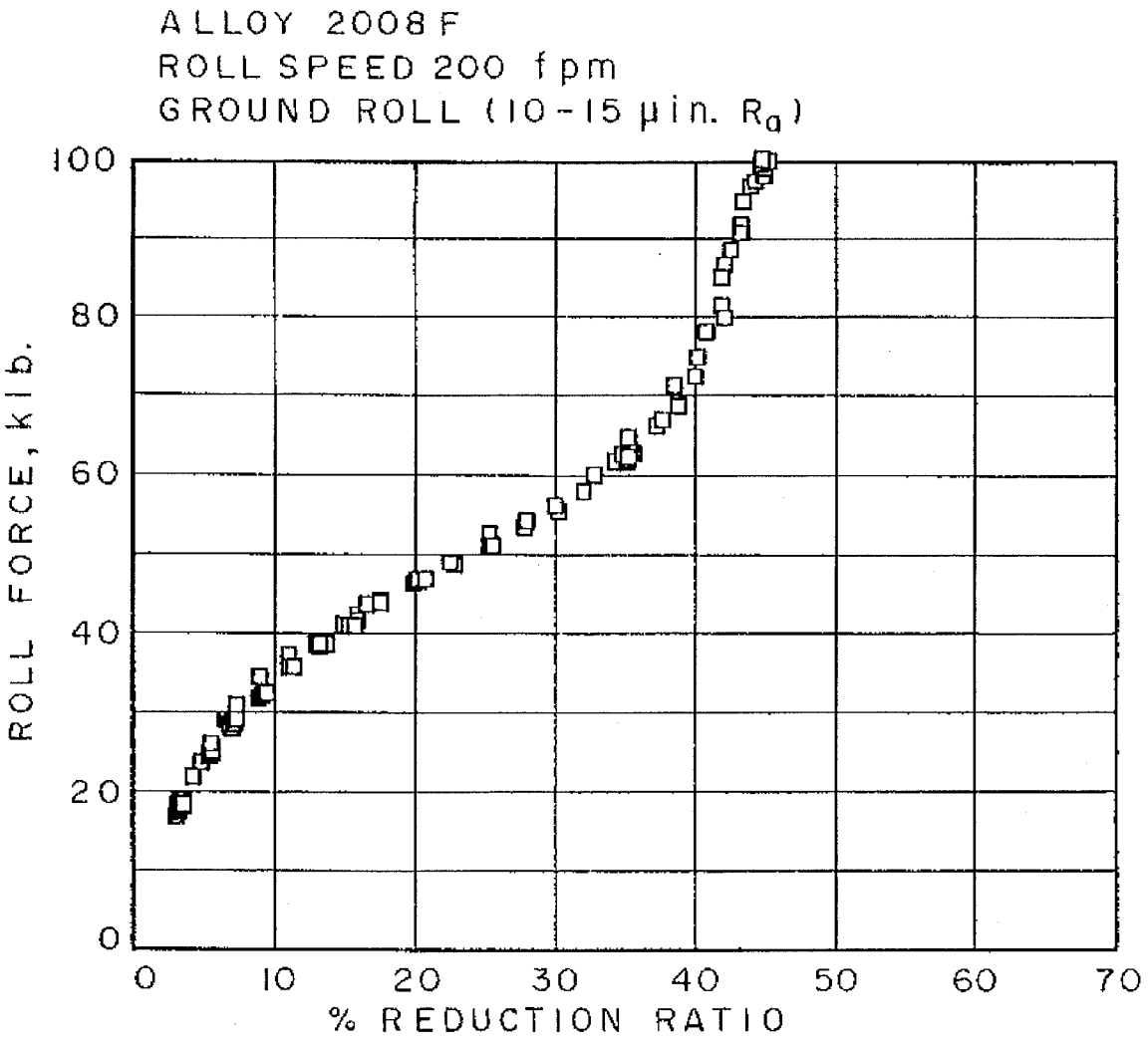
FIG. 24 is a graph showing roll force variation with percentage sheet thickness reduction ratio attainable with ground rolls in a four-high rolling process.

FIG. 24 depicts the variation of roll force with percentage sheet thickness reduction ratio as recorded during four-high rolling of aluminum alloy 2008-F using ground work rolls in a single mill stand. As the percentage thickness reduction ratio increases, the roll force increases in a non-linear fashion until the force capacity of the mill (i.e. 100 kilopounds) is reached at 45% reduction. At this point, the rolling process had to be terminated, as reductions beyond 45% could not be realized.

Figure 25:
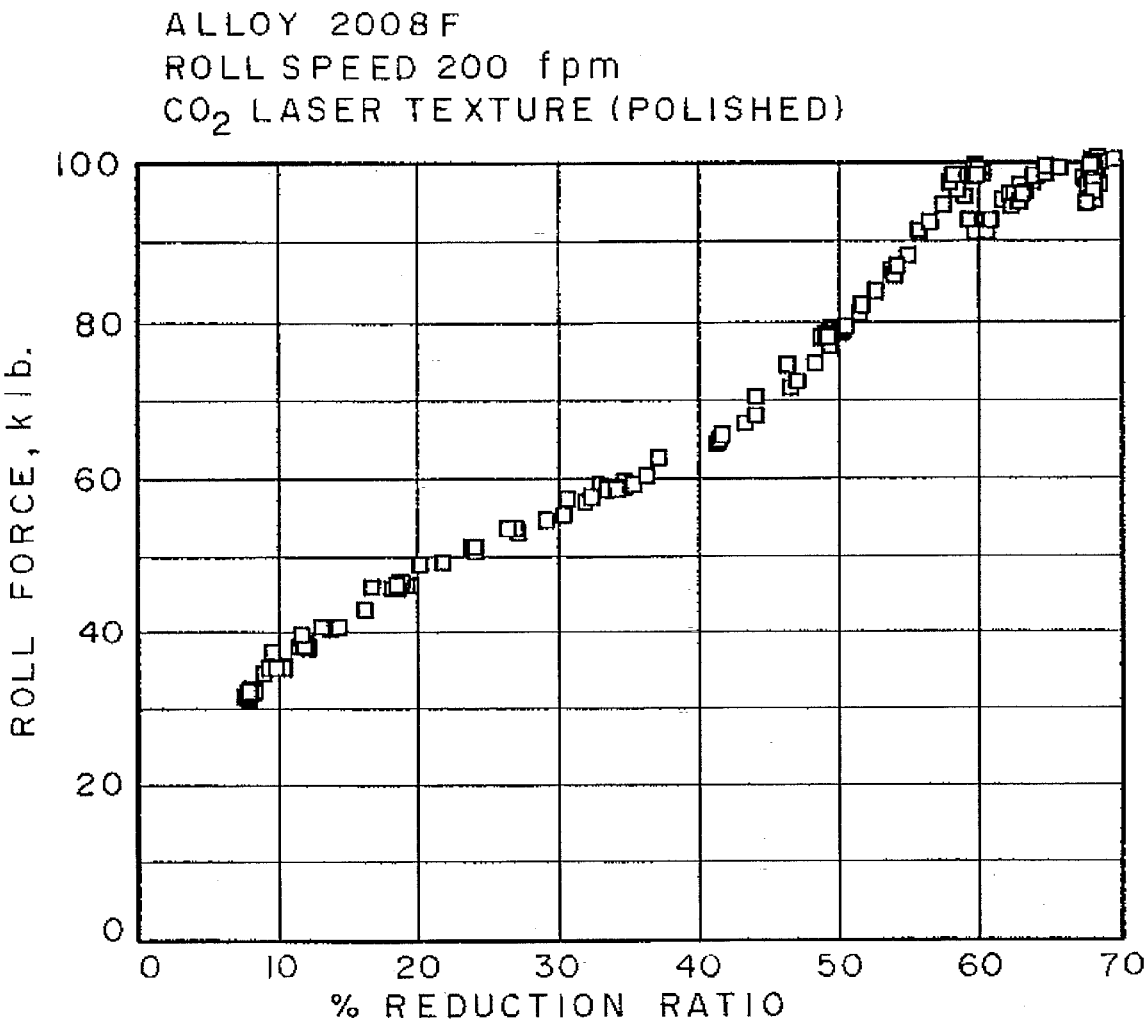
FIG. 25 is a graph showing roll force variation with percentage sheet thickness reduction ratio attainable with the work roll texture of the present invention in a four-high rolling process.

FIG. 25 shows the variation of roll force with percentage sheet thickness reduction ratio recorded under conditions identical to those for FIG. 24, but with work rolls having the bowl-texture of the present invention shown in FIG. 12. The roll force increases somewhat slower than the roll force variation shown in FIG. 24 indicating more favorable tribological conditions when the texture of the present invention is used. The rolling force capacity of the mill is not reached until percentage sheet thickness reductions on the order of 70% are realized. Excessive friction in the roll bite is minimized due to the lack of a substantial roll grind on the textured work roll surface in conjunction with the bowl-texture carrying lubricant into the roll bite that is all or in part expelled to the sheet/work roll interface as microscopic quantifies of sheet surface material extrude into the bowls 16 in the manner depicted in FIGS. 2, 14, 16 and 18.

Figure 26:
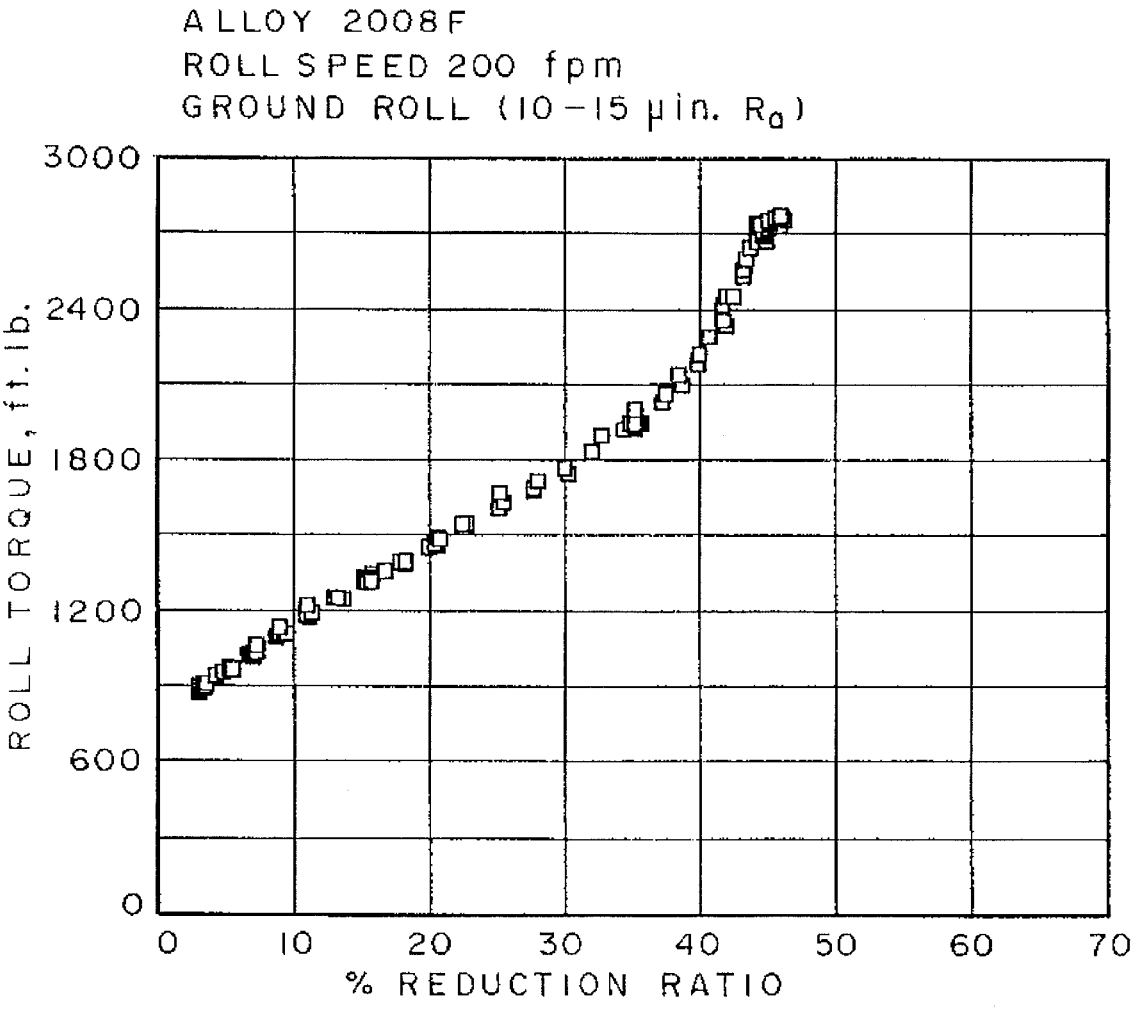
FIG. 26 is a graph showing roll torque variation with percentage sheet thickness reduction ratio attainable with ground rolls in a four-high rolling process.
Figure 27:
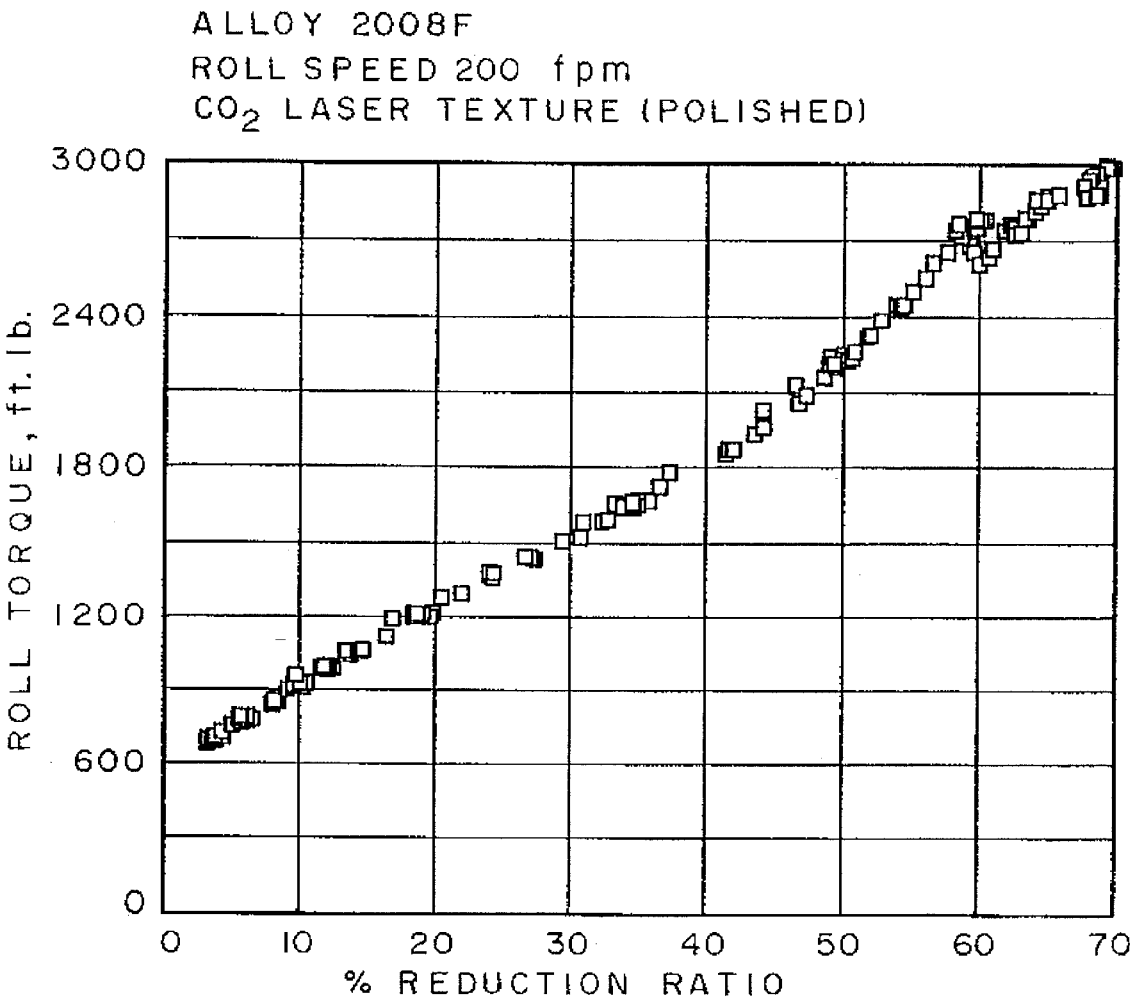
FIG. 27 is a graph showing roll torque variation with percentage sheet thickness reduction ratio attainable with the work roll texture of the present invention in a four-high rolling process.
Figure 28:
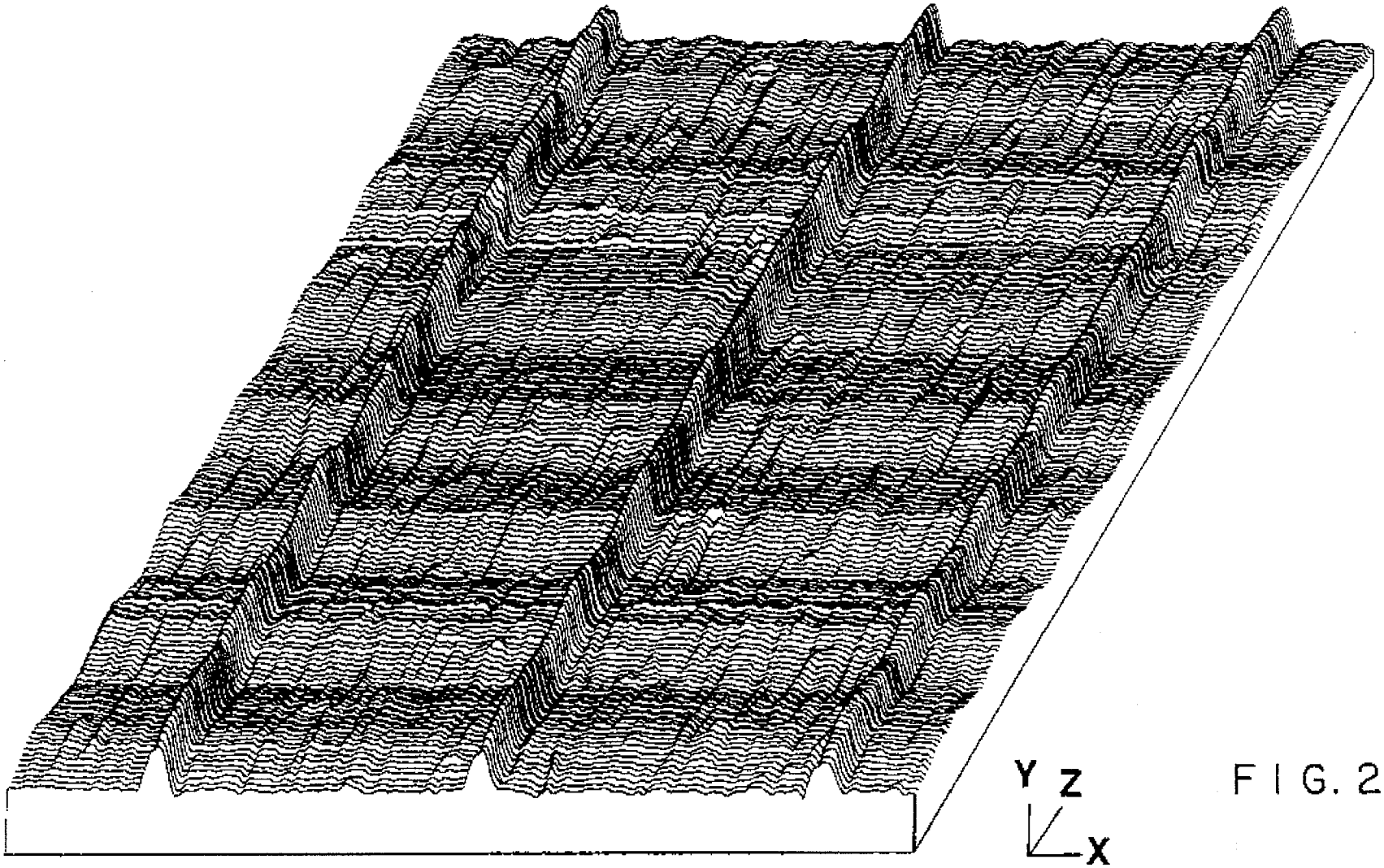
FIG. 28 is a stylus-rendered topography of a 5182 aluminum alloy sheet surface rolled with the work roll texture disclosed in Applicants' U.S. Pat. No. 4,996,113.

FIGS. 26 and 27 represent a comparison of the variation of roll torque with percentage sheet thickness reduction ratios when rolling with ground work rolls and work rolls textured with the invention under the conditions cited for FIGS. 24 and 25. Again, the textured work rolls extend the rolling process capability of the single rolling stand far beyond what is achievable with ground work rolls in that the torque capacity of the stand (3000 ft.-lb) when rolling with the textured work rolls is not reached until 70% reductions realized (FIG. 27), whereas the rolling process using ground work rolls (FIG. 26) had to be terminated at nearly 2700 ft.-ft when a reduction ratio of 45% was achieved. FIGS. 24 to 27 clearly demonstrated that when rolling with work rolls textured with the method of the present invention in a single stand, that the rolling mill capabilities can be extended far beyond the artificial limitations imposed upon the mill due to ground work roll surface finishes and hence the mill can be made to be more productive.

In addition to the aforementioned rolling process enhancements due to the work roll texture of the present invention, the backward prow texture 28*a* and *b* that remains on the sheet surface upon its exit from the roll bite enhances lubrication and metal flow during subsequent metal forming operations, such as press forming of a car body fender, through two significant mechanisms. In the first mechanism, the backward prows 28*a* and *b* can pull lubricant into the sheet/tooling interface owing to their "crescent" morphology. In the second mechanism, the backward prows serve as "barriers" which obstruct lubricant flow along the sheet/tooling interface. Since the lubricant is not free to flow in and out of the interface unimpeded, the lubricant film will persist to later stages of the forming process. This will reduce galling, minimize premature failure of the sheet due to tearing, and protect the tool surface.

A discussion of the lubricant obstruction effect at lubricated interfaces may be found in "An Average Flow Model for Determining Effect of Three-Dimensional Roughness on Partial Hydrodynamic Lubricant," by N. Patir and H. S. Cheng, *ASME Journal of Lubrication Tribology,* Vol. 1130 (1978), pages 12–17.

It should also be noted that skidding between the sheet and roll surfaces will not occur even in the extreme case of a "mirror-finished" work roll textured when using the method of the present invention. This is due to the fact that prow/mound formation is the major traction mechanism in the roll bite and hence "skidding" does not occur during rolling in a single stand of the mill where the massive percentage sheet thickness reduction ratios previously cited are taken. With the method of the present invention, skidding is independent of the background roll roughness, although a background roughness in the form of a directional grind can contribute to the overall traction between the sheet and roll surfaces.

Figure 5:
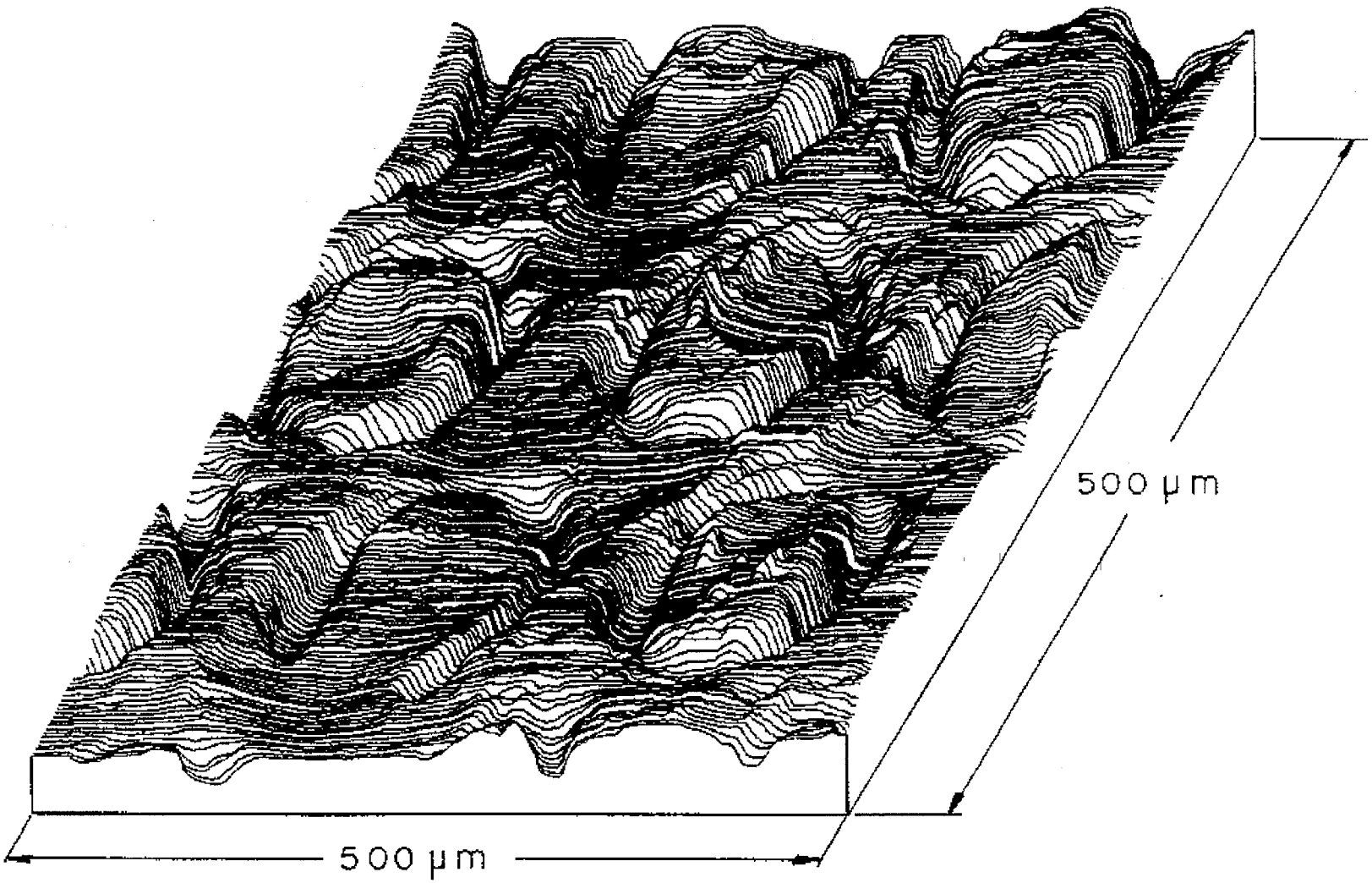
FIG. 5 is a stylus-rendered topography of a portion of a steel sheet surface imperfectly embossed with a work roll surface crater texture.
Figure 6:
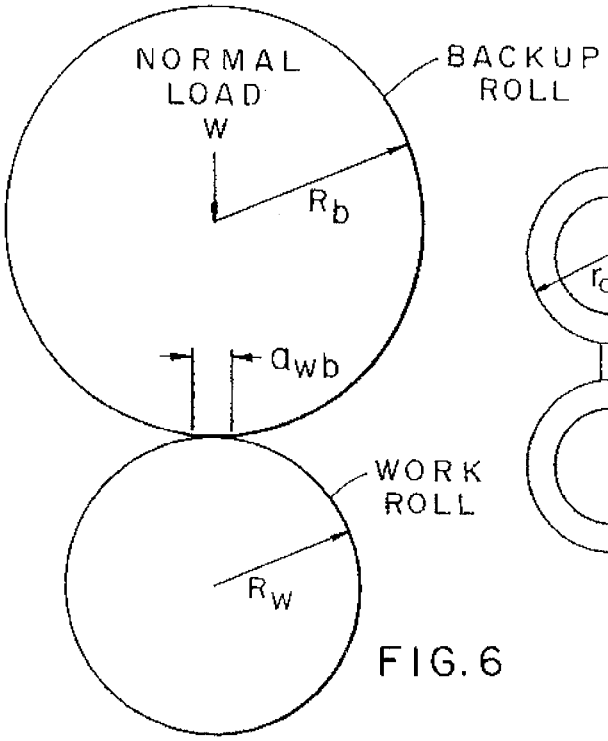
FIG. 6 shows the Hertzian line contact width between a backup roll and a work roll of a rolling mill.
Figure 10:
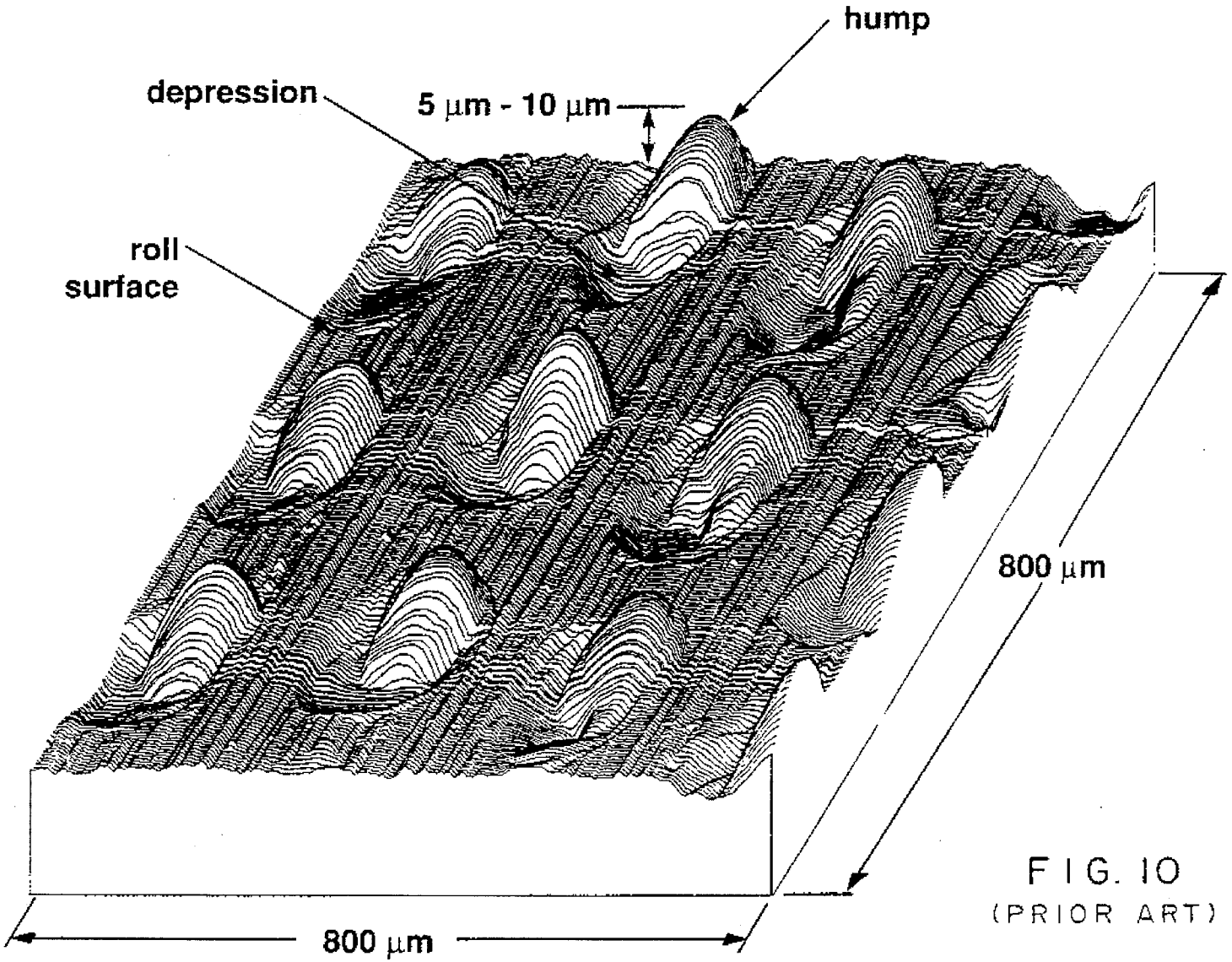
FIG. 10 (PRIOR ART)
FIG. 10 is a stylus-rendered topography of a portion of a work roll surface having the asymmetric "hump" texture produced with a mechanically chopped $CO_2$ laser and an appropriate gas assist according to the method of U.S. Pat. No. 4,806,731, dated Feb. 21, 1989 to Bragard et al.

It should further be noted that the method of the present invention produces sheet surface textures which completely differ from those produced by the common roll texturing technologies such as laser and electron beam texturing. The crater rims 20 (FIG. 8) or asymmetric humps (FIG. 10) produced under the aforementioned melting and surface shearing process due to energy pulses of these technologies are typically left in place along the roll surface with no alteration of them whatsoever. As such, these rims will emboss or indent microscopic recessions in the sheet surface (FIGS. 4 and 5), such recessions lying beneath the sheet surface. One may think of the embossed annular crater texture of FIG. 4 as a castle plateau and moat configuration, in which the annular rims on the work roll surface form the moat on the sheet surface (which subsequently becomes filled with lubricant prior to a stamping operation), and the castle plateau is simply a flat region, which is essentially at the nominal roll surface roughness, and which performs no essential function with respect to lubrication enhancement in subsequent sheet forming processes. The method of the invention, however, produces just the opposite effect in that it leads to microscopic prows as the final sheet surface texture, as the sheet issues from the last stand of a rolling mill, which are raised relative to the average sheet roughness. Also, the prows perform two functions with respect to lubrication enhancement at sheet/workpiece interfaces, instead of the single, lubricant entrapment function performed by the annular crater morphology. The prows not only carry lubricant into a sheet/tool interface, such as is formed in a press working operation, but they also serve as obstacles in the path of lubricant flow along such an interface and hence cause the lubricant to persist along the interface into later stages of forming processes. Moreover, the lubricant which is carried into the interface by the prows is easily distributed to the sheet/tool interface in a press working operation since it is not totally enclosed by an individual prow. This is often not the case with the annular crater morphology embossed in a sheet surface during light thickness reduction rolling since there may well be a small quantity of lubricant remaining within the remnant of the annular "moat" regions on the sheet after the forming process is completed.

The prows of the invention are considerably smaller in overall size than the annular crater morphology and the hump morphology discussed above in reference to FIGS. 3 and 10. In general, automotive manufacturers do not wish to have the sheet texture "show-through" a paint layer and this problem has been associated with the latter two texture morphologies. As such, the prows will not noticeably show through a paint finish on an automotive component.

While the invention has been described in terms of preferred embodiments, the claims appended hereto are intended to encompass all embodiments which fall within the spirit of the invention.

What is claimed is:

1. A rolled aluminum product having a specularly reflective surface provided by an isotropic surface and texture comprised of a reflective surface area provided with raised prows deterministically formed on the specularly reflective surface of the product by a work roll in a rolling mill deterministically provided with discrete, smooth entry, bowl-shaped depressions into which material of a sheet of aluminum extrudes into and is smeared by action of relative velocities of the work roll and sheet of metal when a massive reduction in thickness takes place in a last stand of a rolling mill producing the rolled aluminum product.

2. A rolled aluminum product having at least one isotropic textured surface of micron-sized prows located on reflective surface areas of the rolled product, said product being formed by the method steps of:

passing aluminum material between two lubricated rotating work rolls of a rolling mill, at least one of the rolls having a textured surface comprised of deterministically located, minute, smooth entry, bowl-like depressions, compressing the aluminum material between said rotating work rolls that effects a reduction ratio on the order of 70%, and using the compressing step to form transitory prows on at least one surface of the aluminum material and prows that remain on said one surface of the aluminum material after the material exits the work rolls.

3. A rolled aluminum product having at least one isotropic textured surface of micron-sized prows located on reflective surface areas of the rolled product, said product being formed by the method steps of:

passing metal aluminum material between lubricated rotating work rolls of a stand of a rolling mill at a torque capacity of the stand on the order of 3,000 foot-pounds, with at least one of the rolls having a textured surface comprised of deterministically located, minute, smooth entry, bowl-like depressions, compressing the aluminum material between the two lubricated rotating work rolls, and using the compressing step to form transitory prows on at least one surface of the aluminum material and prows that remain on said one surface after the aluminum material exits the work rolls.

4. An aluminum sheet product having a specularly reflective surface provided by a substantially isotropic texture comprised of reflective surface areas and minute raised prows located on the reflective surface, said prows providing the isotropic texture on the surface, and having predetermined, controlled, consistent dimensions in micron-sized ranges, as provided by a work roll of a rolling mill having a mirror finish and discrete, smooth entry, bowl-shaped depressions into which material of the sheet product enters when massive reductions are taken in the thickness of a sheet of aluminum material that forms the sheet product, the entry of aluminum material into the bowl-shaped depressions providing the prows and isotropic prow texture.

* * * * *

UNITED STATES PATENT AND TRADEMARK OFFICE

CERTIFICATE OF CORRECTION

PATENT NO. : 5,537,851

DATED : July 23, 1996

INVENTOR(S) : Shen S. Sheu et al.

It is certified that error appears in the above-indentified patent and that said Letters Patent is hereby corrected as shown below:

Col. 22, Claim 3, line 15 Delete "metal"

Signed and Sealed this

Fourth Day of March, 1997

*Attest:*

*Attesting Officer*

BRUCE LEHMAN

*Commissioner of Patents and Trademarks*